US005461462A

United States Patent [19]

Nakane et al.

[11] Patent Number: 5,461,462

[45] Date of Patent: Oct. 24, 1995

[54] IMAGE FORMING APPARATUS HAVING A FUNCTION THAT AUTOMATICALLY ADJUSTS A CONTROL STANDARD VALUE FOR CONTROLLING IMAGE QUALITY

[75] Inventors: Rintaro Nakane, Yokohama; Jiro Egawa, Yokosuka, both of Japan

[73] Assignee: Kabushiki Kaisha Toshiba, Kawasaki, Japan

[21] Appl. No.: 124,188

[22] Filed: Sep. 21, 1993

[30] Foreign Application Priority Data

Sep. 25, 1992 [JP] Japan ..... 4-280436
Sep. 10, 1993 [JP] Japan ..... 5-225339

[51] Int. Cl.[6] ..... G03G 15/06
[52] U.S. Cl. ..... 355/208; 355/246
[58] Field of Search ..... 355/208, 246

[56] References Cited

U.S. PATENT DOCUMENTS 4,975,745 12/1990 Tanaka et al. ..... 355/211
5,124,751 6/1992 Fukui et al. ..... 355/246
5,196,886 3/1993 Nakane et al. ..... 355/246
5,198,852 3/1993 Mikami ..... 355/246 XR
5,357,317 10/1994 Fukuchi et al. ..... 355/208

*Primary Examiner*—Fred L. Braun
*Attorney, Agent, or Firm*—Foley & Lardner

[57] ABSTRACT

According to an image forming apparatus and method of the present invention, an image of an original is read by an image reader unit, a correction of gradation reproduction or a pseudo gradation processing is provided to the read image data by an image processing section. When an image corresponding to the image-processed image data is printed out on a sheet material, a gradation chart for image forming conditions is outputted, a number of gradations corresponding to the image forming conditions, the image forming conditions corresponding to the number of gradations are detected, and a test pattern for gradation reproduction is outputted based on the detected image forming condition is outputted. The test pattern is read again by the image reader unit. Newly read gradation data and gradation data of the test pattern are compared with each other, and correction data for every gradation of the plurality of the gradation is calculated. The corrected data is calculated a predetermined number of times and stored, so that an average value is renewed.

19 Claims, 15 Drawing Sheets

IMAGE FORMING APPARATUS HAVING A FUNCTION THAT AUTOMATICALLY ADJUSTS A CONTROL STANDARD VALUE FOR CONTROLLING IMAGE QUALITY

BACKGROUND OF THE INVENTION

1. Field of the Invention

The present invention relates to an image forming apparatus, and more particularly to an apparatus, which can maintain image density (gradation reproduction) of a color laser printer having a plurality of developers constant regardless of a individual difference of the apparatus or a mounting environment.

2. Description of the Related Art

For example, many users experience that copies obtained by copying the same original using the same copying machine have different densities. In an electrophotograph, an image density drift occurs under the influence of a change or deterioration of image forming conditions due to different environmental factors and an elapse of time. It is important for a multi-level printer or a digital copying machine as well as an analog copying machine to suppress and stabilize the image density drift. In particular, in a color image, since the image density drift influences not only density reproducibility but also color reproducibility, a stable image density is an indispensable requirement. Therefore, in a conventional apparatus, a given allowable margin is provided to image forming materials and an image forming process itself, and image stabilization is attained by maintenance within this allowable margin.

However, the allowable margin to be provided to the image forming materials and image forming process itself is limited, and the maintenance requires much labor and cost. Furthermore, the image density drift cycle is shorter than a maintenance cycle, and a stable image density cannot always be obtained by only the maintenance.

In this type of the digital copy apparatus, the relationship between the signal inputted from the image reader and density of an output image due to the printer is measured in advance, and a y characteristic, that is, a correlation between a reading characteristic of the image reader and an output characteristic of the printer can be obtained. Then, a correction parameter, which can provide an optimum y characteristic, is calculated. The calculated correction parameter is stored in a ROM (Read Only Memory), and is used to correct the signal inputted from the image reader in the form of a LUT (Look-up Table), thereby the gradation reproduction is improved.

However, in the conventional method, since the gradation reproduction cannot be adjusted under an image forming condition in which a developing characteristic is optimized by the correction parameter stored in LUT, texture is easily generated, and a favorable gradation expression and stability cannot maintained. Therefore, there is a problem in that the gradation reproduction cannot fully provided under the individual difference of the digital copy apparatus or the mounting environment.

In U.S. Pat. No. 4,975,745, (filed: Oct. 26, 1989), there is disclosed a method for forming two reference density patterns, measuring potentials of the respective patterns, and changing an image forming condition.

SUMMARY OF THE INVENTION

An object of the present invention is to provide a color laser printer which can adjust a gradation reproduction of a gradation characteristic under an image forming condition in which a developing characteristic is optimized.

Another object of the present invention is to provide a color laser printer which can prevent texture from being generated.

Further another object of the present invention is to provide an image forming apparatus which can maintain a preferable gradation expression and stability, and adjust a gradation reproduction regardless of an individual difference of the apparatus and a mounting environment.

According to the an aspect of present invention, there is provided an image forming apparatus, comprising means for forming an image of a predetermined pattern on an image bearing member with developer having toner under a predetermined image forming condition, means for detecting an amount of toner attached onto the image bearing member by the forming means, first calculating means for calculating a deviation between the amount of toner detected by the detecting means and a reference value of the amount of toner attached to the image bearing member corresponding to the predetermined pattern, first designating means for designating an adjusting mode to adjust the image forming apparatus, first actuating means, in response to the designation of the first designating means, for actuating the forming means, the detecting means, and the first calculating means, means for changing the image forming condition in accordance with the deviation calculated by the first calculating means, first executing means for repeatedly executing processings of the forming means, the detecting means, the first calculating means, and the changing means at a predetermined times, second calculating means for calculating a reference range of a deviation for discriminating whether or not the image forming condition is changed, in accordance with the deviation calculated repeatedly by the first executing means, means for storing the reference range calculated by the second calculating means, second designating means for designating an image forming mode to form an image on the image bearing member, second actuating means, in response to the designation of the second designating means, for actuating the forming means, the detecting means, the first calculating means and the changing means, and second executing means for executing a changing processing of the image forming condition during the deviation calculated by the first calculating means is larger than the reference range stored in the storing means so as to stabilize image density changes of the image formed on the image bearing member.

According to another aspect of the invention an image forming apparatus, comprising means for forming an image of a predetermined pattern on an image bearing member with developer having toner under a predetermined image forming condition, means for detecting an amount of toner attached onto the image bearing member by the forming means, means for calculating a deviation between the amount of toner detected by the detecting means and a reference value of the amount of toner attached to the image bearing member corresponding to the predetermined pattern, means for designating an adjustment mode to adjust the image forming apparatus, means for actuating, in response to the designation of the designating means, the forming means, the detecting means, and the calculating means, first changing means for changing the image forming condition in accordance with the deviation calculated by the calculating means, executing means for repeatedly executing processings of the forming means, the detecting means, the calculating means, and the changing means at a predetermined times, means for storing a translation table for providing a correction of gradation to image data corresponding to an image formed on the image bearing member, and second changing means for changing a value of the translation table stored in the storing means in accordance with the image forming condition finally changed by the changing means when the processing of the changing means is repeated executed by the executing means.

According to further aspect of the invention a method for forming an image, comprising a forming step for forming an image of a predetermined pattern on an image bearing member with developer having toner under a predetermined image forming condition, a detecting step for detecting an amount of toner attached onto the image bearing member by the forming step, a first calculating step for calculating a deviation between the amount of toner detected by the detecting step and a reference value of the amount of toner attachment corresponding to the predetermined pattern, a first designation step for designating an adjustment mode to adjust the image forming apparatus, a first operating step for operating, in response to the designation of the first designating step, the forming step, the detecting step, and the first calculating step, a first changing step for changing the image forming condition in accordance with the deviation calculated by the first calculating step, a repeating step for repeating the processings of the forming step, the detecting step, the first calculating step, and the changing step at a predetermined times, a second calculating step for calculating a reference range of a deviation for discriminating whether or not the image forming condition is changed, in accordance with the deviation calculated by the repeating step, a storing step for storing the reference range calculated by the second calculating step, a second designating step for designating an image forming mode to form an image on the image bearing member, a second operating step for operating, in response to the designation of the second designating step, the forming step, the detecting step, and the first calculating step, a third operating step for operating to change the image forming condition during the deviation calculated by the first calculating step is larger than the reference range stored by the storing step so as to stabilize image density changes of the image formed on the image bearing member.

According to still another aspect of the invention a method for forming an image, comprising steps of forming an image of a predetermined pattern on an image carrier body by use of developer having toner under a predetermined image forming condition, detecting an amount of toner provided to the image carrier body by the forming step, calculating a deviation between the quantity of toner detected by the detecting step and a reference value of the amount of toner adhesion corresponding to the predetermined pattern, designating means for designating a control mode to an image forming apparatus, operating in response to the designation of the designation step the forming step, the detecting step, and the calculating step, changing the image forming condition in accordance with deviation calculated by the calculating step, repeating the processings of the image forming step, the detecting step, the calculating step, and the changing step a predetermined times, and changing a value of a translation table stored by the storing step in accordance with the image forming condition repeated by the repeating step and finally changed by the changing step.

According to still further aspect of the invention a method for forming an image, comprising a detecting step of detecting amount of toner attachment of a pattern formed on an image bearing member, a calculating step of calculating a deviation corresponding to a reference value in accordance with the detection result, an image condition setting step of setting an image condition to change the image forming condition in accordance with the calculated deviation when the calculated deviation of the calculating step is over a discrimination reference range, a first determining step of determining the reference value to be used for calculating the deviation of the calculating step, a second determining step of determining the discrimination reference range to be used for discriminating whether or not the image forming condition is changed, and an operating step of operating the image condition setting step with the reference value and discrimination reference range obtained in the first and second determining steps.

According to still another a method for forming an image, comprising a detecting step of detecting amount of toner attachment of a pattern formed on an image bearing member, a calculating step of calculating a deviation corresponding to a reference value in accordance with the detected amount, an image condition setting step of setting an image condition to change the image forming condition based on the calculated deviation when the calculated deviation is over a discrimination reference range, a first determining step of determining the reference value to be used for calculating the deviation, a second determining step of determining the discrimination reference range to be used for discriminating whether or not the image forming condition is changed, a third determining step of determining a content of data converting means for correcting an original image and a gradation characteristic of a formed image under an image forming condition after the second determining step is ended, and an image forming step of forming an image corresponding to a converted original image in accordance with content of data converting means determined by the third determining step under the image forming condition set by the image condition setting step by use of the reference value and discrimination reference range determined by the first and second determining steps.

According to still further aspect of the invention an image forming apparatus, comprising first storing means for storing predetermined gradation data, means for forming a pattern in accordance with the gradation data, detecting means for detecting amount of toner attachment of the pattern, second storing means for storing a reference value for calculating a deviation from the amount of toner attachment, first calculating means for calculating the deviation from the amount of toner attachment and reference value, third storing means for storing a discrimination reference for discriminating whether or not an image forming condition is changed from the deviation, means for discriminating whether or not the image forming condition is changed in accordance with the deviation and a discrimination reference, means for changing the image forming condition based on the discrimination result of the discriminating means and the deviation, first designating means for designating a desirable gradation data, fourth storing means for storing gradation data designated by the first designating means, second designating means for designating the start of setting operation of the reference value and discrimination reference, first setting means, operated in accordance with the designation of the second designating means, for forming a pattern corresponding to gradation data stored in the fourth storing means on an image bearing member under a predetermined image forming condition, detecting amount of toner attachment of the pattern, and storing the amount of toner attachment in the second storing means as a reference value, and second setting means for forming a pattern corresponding to predetermined gradation data stored in the first storing means on the image bearing member, detecting amount of toner attachment of the pattern, calculating a deviation from the amount of toner attachment and reference value, storing the deviation in fifth storing means, changing the image forming condition in accordance with the deviation, repeating the pattern forming, detecting, calculating, storing, and changing a predetermined number of times, calculating the discrimination reference in accordance with the deviation stored in the fifth storing means, and storing the calculated discrimination reference in the third storing means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

A full colored laser beam printer apparatus (image forming apparatus) to which an embodiment of the present invention is incorporated in detail with reference to the drawings.

Figure 1:
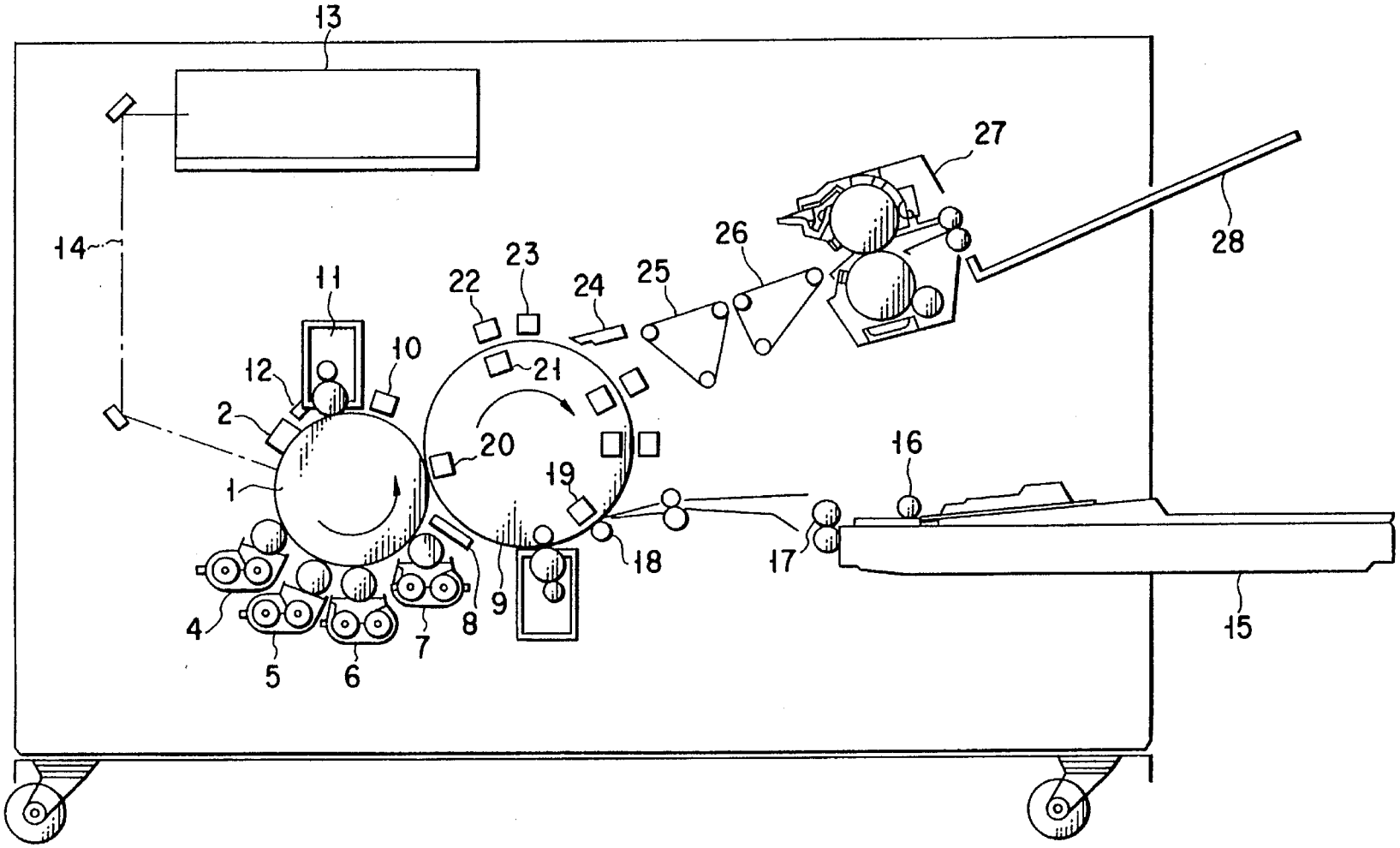
FIG. 1 a schematic cross sectional view of a color laser printer to which an embodiment of the present is incorporated.

In FIG. 1, a full colored laser beam printer apparatus (hereinafter called as printer) includes a photoconductive drum 1 for electrostatically forming an image to be printed out by an electrophotography process, a charging unit 2, which is arranged around the photoconductive drum 1 along a direction where the photoconductive drum 1 is rotated, for providing a predetermined charge to the surface of the photoconductive drum 1, first through fourth developing units 4 to 7 for forming toner image by supplying colored toner to an electrostatic latent image formed on the photoconductive drum 1, a measuring device 8 for measuring toner adhesion quantity, a transfer drum 9 serving as a support of transfer material, pre-cleaning discharger 10 for eliminating electrostatic adsorption between the surface of the photoconductive drum 1 and toner, a cleaner 11 for removing toner remained on the surface of the photoconductive drum 1, and a discharging lamp 12 for returning a charge distribution of the photoconductive drum 1 to an initial state.

The photoconductive drum 1 is rotated in a direction of an arrow, and the surface of the photoconductive drum 1 is uniformy charged by the main charging unit 2. A laser beam L, which is emitted from a laser exposer 13, is, radiated on the surface of the photoconductive drum 1 from a slit area between the charging unit 2 and the first developing unit 4, so that an electrostatic latent image is formed on the photoconductive drum 1 in accordance with image data.

Toner of magenta, cyan, yellow and black is supplied to the first through fourth developing units 4 to 7, respectively.

On the other hand, a sheet of paper is fed from a paper cassette 15 by a feed roller 16, and once stopped through a registration roller 17, thereafter its inclination is corrected. Paper stopped at the registration roller 17 is fed to be absorbed at a predetermined position of the transferring drum 9 when the registration roller 17 is urged to be driven again. Paper fed toward the transferring drum 9 is electrostatically absorbed to the transferring drum 9 by an attraction (forward) roller 18 and an attraction charge unit 19. The paper is conveyed with the clockwise rotation of the transferring drum 9 in a state that the paper is absorbed to the transferring drum 9.

A developed toner image on the photoconductive drum 1 is transferred to transferring paper at a position where the photoconductive drum 1 and the transferring drum 9 are opposed to each other by a transfer charger unit 20. In a case that a plurality of colors is used in printing, a process in which one rotation of the transferring drum 9 is used as one period is repeated in order through a plurality of developing units having a corresponding toner, so that the toner image of a plurality of colors is transferred in a multiplexing manner.

The paper on which the toner image is transferred is carried with the rotation of the transferring drum 9, and discharged by an inside separating discharger unit 21, an outside separating discharger 22, and a main separating discharger unit 23.

Thereafter, paper is separated from the transferring drum 9 by a separator 24, and conveyed to a fixing unit 27 through first and second conveyers 25 and 26. The fixing unit 27 heats toner on the paper to be melted, so that toner is adhered to the paper. Paper on which toner is fixed is discharged to a tray 28.

Figure 2:
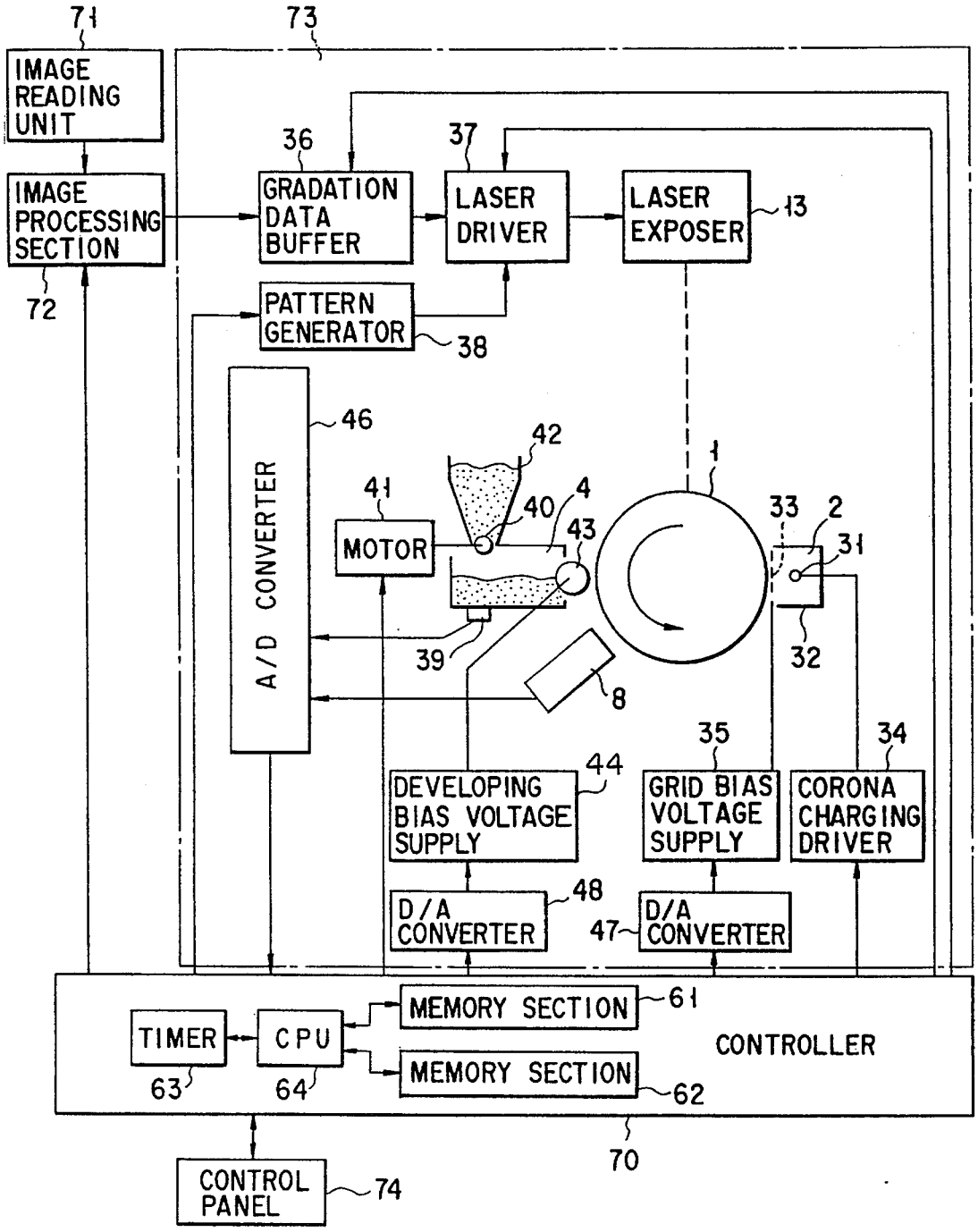
FIG. 2 is a block diagram showing the structure of the color laser printer of FIG. 1 and a connection among a corona charging unit, a laser exposer, and a developing unit.

FIG. 2 is a block diagram showing the structure of the printer apparatus of FIG. 1, discharging means, exposing means, developing means, and controlling means.

The printer apparatus has a main controller 70 for controlling the entire apparatus, an image reader unit 71 for reading an image of an original, an image processing section 72 for converting the image read by the image reader unit 71 to a printing image to be used in printing out, a laser printer unit 73 serving as an image forming section, and a control panel 74, which is capable of inputting various operation modes or numerical data and providing a display corresponding to the inputted data or set mode.

A rewritable memory section 61, which includes an EEPROM in which data is not erased if power is turned off, a memory section 62, which includes a RAM for data storing, a timer 63 for measuring waiting time, and a CPU 64 for controlling the entire controller 70 are connected to the controller 70.

In the memory section 61, various setting values are stored in advance. For example, the following values are stored:

Specifically, there are stored an initial grid bias voltage value, which corresponds to a bias condition as a reference gradation characteristic, i.e., normal temperature and humidity, and an initial developing bias voltage value; test pattern gradation data (high density area, low density area); a predetermined target value of toner adhesion quantity of the high density (this value is used in obtaining deviation); a predetermined target value of toner adhesion quantity of the low density area (this value is used in obtaining deviation); a control standard value in connection with the deviation of the high density area; a control standard value to the deviation of the low density area; a coefficient showing a surface potential characteristic; a predetermined number of paper to be printed out; a predetermined passing time; the maximum number of times of control, a bias conditional value; an abnormal range of the measuring device 8 for measuring the toner adhesion quantity; and upper and lower limit values (predetermined range) of each of an amount of reflected light of an area other than the test pattern area, and an amount of reflected light of the high density area, and an amount of reflected light of the low density area.

Also, in the memory section 61, there are stored a table of an amount of the change of a contrast voltage and a table of the change of a background voltage. Moreover, in the memory section 61, there are stored a table of image data (density data) for every gradation corresponding to the test pattern, which is used for initializing and controlling the gradation reproduction, and a table of pulse width modulating data for every gradation corresponding to a gradation chart, which is used for initializing and controlling the image forming condition, and font data corresponding to the number of gradations.

In the memory section 62, a bias value, which is set before the abnormality state of the measuring device 8 for measuring the toner adhesion quantity, is stored when a bias change mode is set. Moreover, in the memory section 62, there are stored a counter for counting the number of times of control, a counter for counting the number of paper to be printed out, a sensor abnormal flag, which is turned on at the time of the abnormality state of the measuring device 8 for measuring the toner adhesion quantity, and a toner empty flag, which is turned on when toner is empty.

The image reader unit 71 reads an image of the original mounted on an original base (not shown) by use of a CCD line sensor (not shown), converts the image read from the CCD sensor to digital image signal by use of an A/D converter (not shown), and outputs digital image signal to the image processing section 72.

The image processing section 72 image-processes image data sent from the image reader unit 71, thereby outputting density data of each pixel unit corresponding to the gradation of the laser beam printer unit 73.

Figure 3:
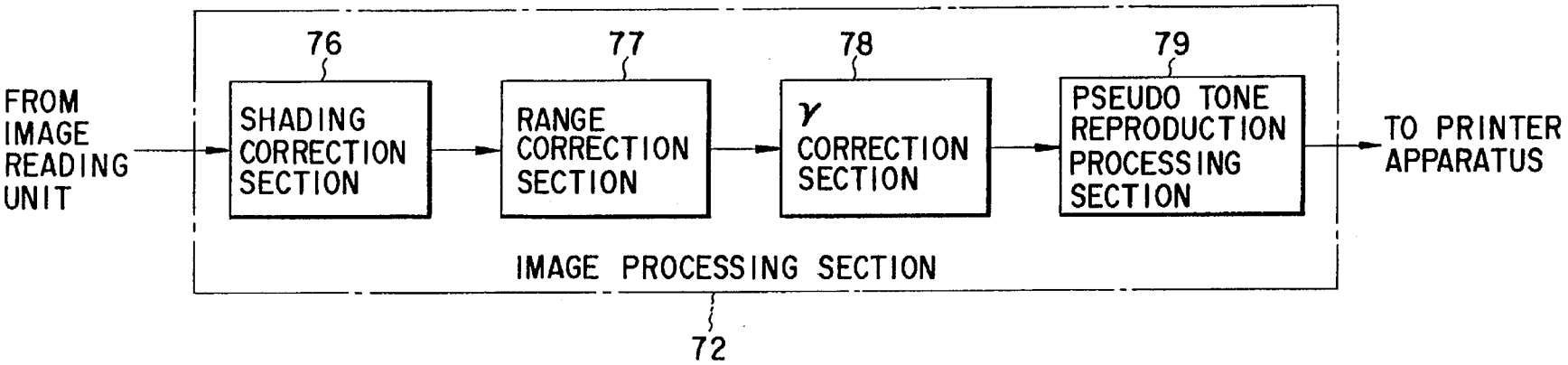
FIG. 3 is a block diagram showing an outline of an image processing unit.

As shown in FIG. 3 to be explained later, the image processing section 72 has a shading correction section 76, which performs shading-correction to image data supplied from the image reader unit 71, that is, for correcting an output level due to the individual difference of the CCD line sensor, a range correction section 77 for correcting an output range, which is shading-corrected by the shading correction section 76, a γ correction section 78 for correcting a γ-characteristic for obtaining an equal output image density against the input image density of image data, which is range-corrected by the range correction section 77, and a pseudo gradation processing section 79 for pseudo gradation processing in order to change image data, which is γ (gamma)-corrected by the γ (gamma) correction section 78, to image data corresponding to the number of gradation of the laser beam printer unit 73 by use of an error diffusion method.

Figure 4:
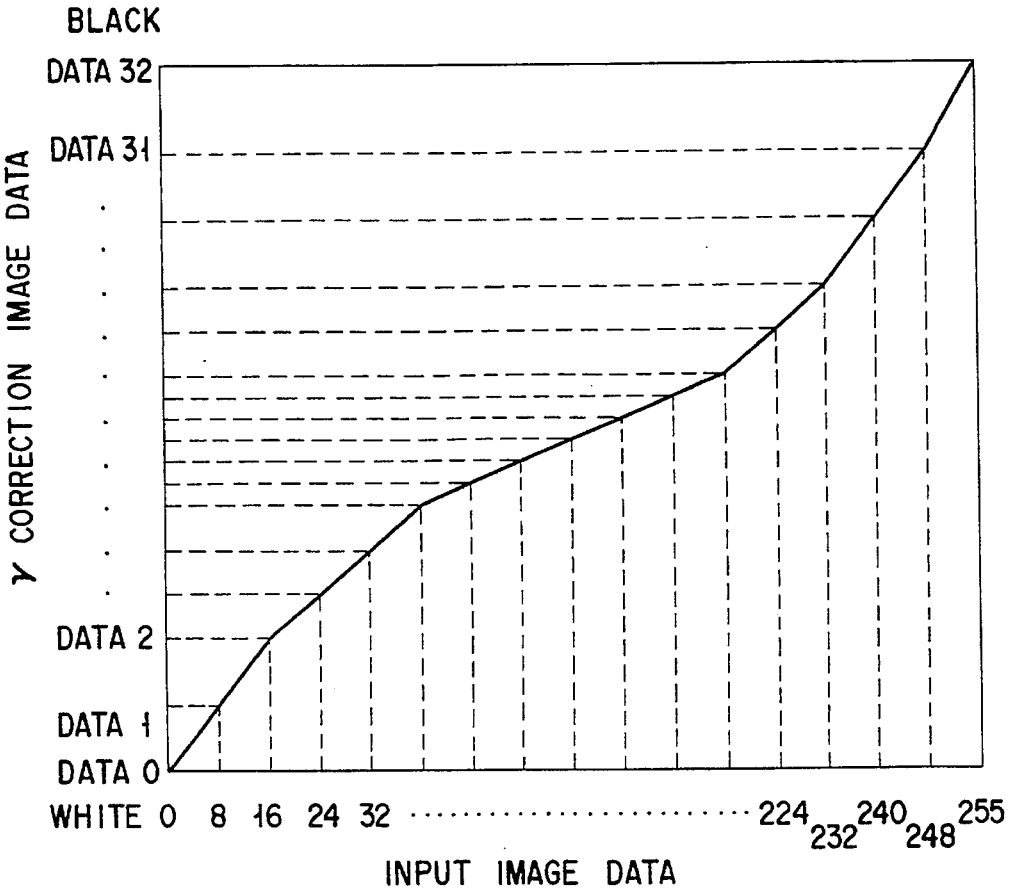
FIG. 4 is a graph showing a characteristic of input image data, which is γ (gamma)-corrected.

The γ correction section 78 corrects a γ-characteristic by use of correction data for γ correction, which is stored in the memory section 61 in advance. More specifically, the γ correction section 78 substantially linearly approximates the gradation characteristic of the output image to the input image density. For example, γ correction data (33 bytes), which corresponds to input image data as density data of each of 256 gradations, is stored in the memory section 61 (see FIG. 4).

Image data (density data) for every gradation corresponding to the test pattern, which is read from the memory section 61 by CPU 64 of the controller 70 so as to initialize and control the gradation reproduction, is supplied to the pseudo gradation processing section 79.

An operation of the printer apparatus will be explained in detail with reference to FIGS. 1 and 2.

An operation start signal (not shown) is inputted through the control panel 74, thereby the photoconductive drum 1 is rotated in a direction of the arrow. The charging unit 2 has a corona wire 31, a conductive case 32, a grid screen 33. The corona wire 31 is connected to a corona charging driver unit 34, so that a predetermined electric charge is charged on the surface of the photosensitive drum 1. The grid screen 33 is connected to a grid bias voltage supply 35, and controls density of corona charge to be supplied to the drum 1.

On the surface of the photoconductive drum 1, which is uniformly charged by the charging unit 2, an electrostatic latent image is formed by exposure of modulated laser beam light L emitted from the laser exposer 13. A gradation data buffer (pulse width correction section) 36 stores gradation data sent from the image processing section 72 or CPU 64 of the main control unit 70, and corrects the gradation characteristic to be converted to laser exposure time (pulse width) data.

A laser driver 37 has a pulse width modulation section (not shown), which modulates a laser driving current (light emitting time) in accordance with laser exposure time data sent from the gradation data buffer 36 in order to synthesize with a scanning position of the laser beam light L. Then, a semiconductor laser (not shown) in the laser exposer 13 is driven by the modulated laser driving current. Pulse width modulation data for every gradation corresponding to a gradation chart, which is read from the memory section 61 by CPU 64 of the controller 70 so as to initialize and control the gradation reproduction, and font data corresponding to the number of gradations are supplied to the laser driver 37. The semiconductor laser (not shown) outputs a laser beam having a predetermined density in accordance with exposure time data supplied from the laser driver 37.

Moreover, the laser driver 37 has a monitoring photodetector (not shown), which is integrally incorporated into the laser exposer 13, compares an output of the detector with a set value, and controls the amount of the outputted light based on the set value.

On the other hand, a pattern generator 38 generates gradation data of the test patterns each having a different density, i.e., low density and high density for measuring the amount of toner adhesion, and sends gradation data to the laser driver 37. The test pattern, which is stored in the memory section 61, may be used.

In two test patterns to gradation data, one is set to the high density test pattern, and the other is set to the low density test pattern.

The electrostatic latent image formed on the photoconductive drum 1 is developed by the developing unit 4 (the following explanation will be based on the first developing unit 4).

The developing unit 4 uses two component developing system, and contains developer, which is formed of toner and carrier. A weight ratio of the developer to toner (hereinafter called as toner density) is measured by a toner density measuring section 39. Then, a toner supply motor 41, which drives a toner supply roller 40, is controlled in accordance with the output of the toner density measuring section 39. Thereby, toner in a toner hopper 42 is supplied to the developing unit 4.

A developing roller 43 of the developing unit 4 is formed of conductive material, and connected to a developing bias voltage supply 44. The roller 43 is rotated in a state that a developing bias voltage is applied thereto, and toner is adhered to the image in accordance with the electrostatic latent image on the photoconductive drum 1. The toner image in such a developed image area is transferred to a sheet of paper supported and carried by the transferring drum 9.

The controller 70 controls the pattern generator 38 to generate gradation data at the time of ending warm-up processing after power supply. Thereby, high and low gradation patterns for measuring an amount of toner adhesion are exposed on the photoconductive drum 1.

The portions at which high and low gradation patterns are exposed are respectively developed, and the measuring device 8 measures the toner adhesion quantity. The output of the measuring device 8 is digitized by an A/D converter 46, and inputted to the controller 70.

Figure 5:
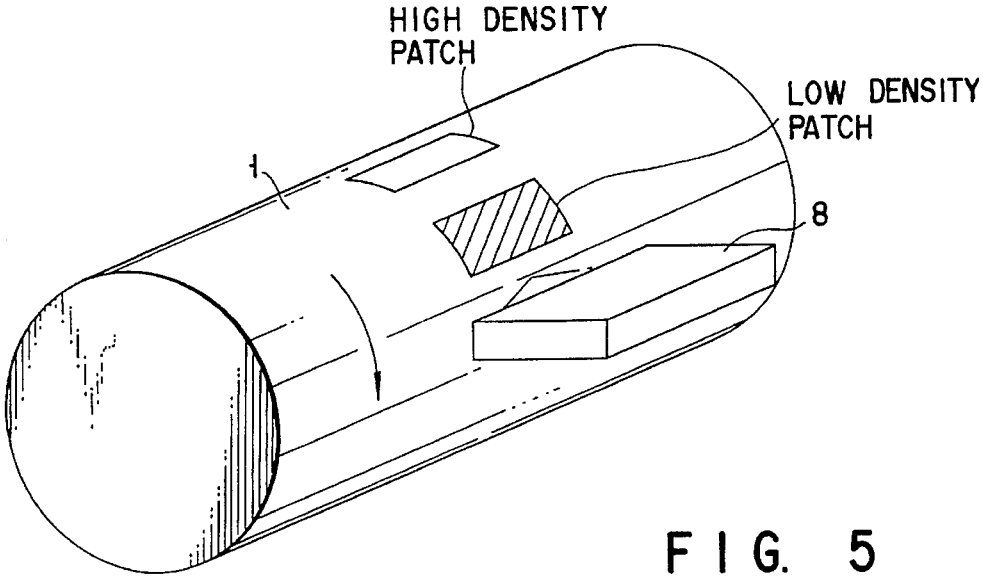
FIG. 5 is a schematic view showing a high density area corresponding to gradation data of high density developed on a photoconductive drum, a low density are to gradation data of low density, and a measuring unit for toner adhesion quantity.

As shown in FIG. 5, by the above-explained development, a test pattern area (high density patch:high density area), which corresponds to gradation data of high density and a test pattern area (low density patch:low density area), which corresponds to gradation data of low density, are formed on the photoconductive drum 1.

The controller 70 compares the output of the measuring device 8 (measured value) with a reference value, which is set in advance, and changes the grid bias voltage of grid screen 33 of the charging unit 2 and the developing bias voltage of developing roller 43 of the developing unit 4, which are the image forming conditions. Moreover, the controller 70 changes gradation data, which is sent from an outer unit (not shown) or the controller, and gradation data of the test pattern of the printer and the pattern for measuring the toner adhesion quantity, and fetches each output of the measuring devices 8 and 39. Also, the controller 70 controls the outputs of the high voltage power supplies 34, 35, and 44, and sets the target value of the laser driving current and that of toner density. Furthermore, the controller 70 controls supply of toner or correction of gradation characteristic of the printer to gradation data.

Specifically, the high voltage power supplies 35 and 44 are controlled by an output voltage control signal, which is supplied from the controller 70 through D/A converters 47 and 48.

The bias conditional values are that the upper and lower limit values of each of the grid bias and the developing bias, and the differential voltage between the grid bias and the developing bias are set to be within the predetermined range.

The target value of the high density area and that of the low density area are changeable by the input from the control panel 74, and each target value is displayed on the control panel 74.

Figure 6:
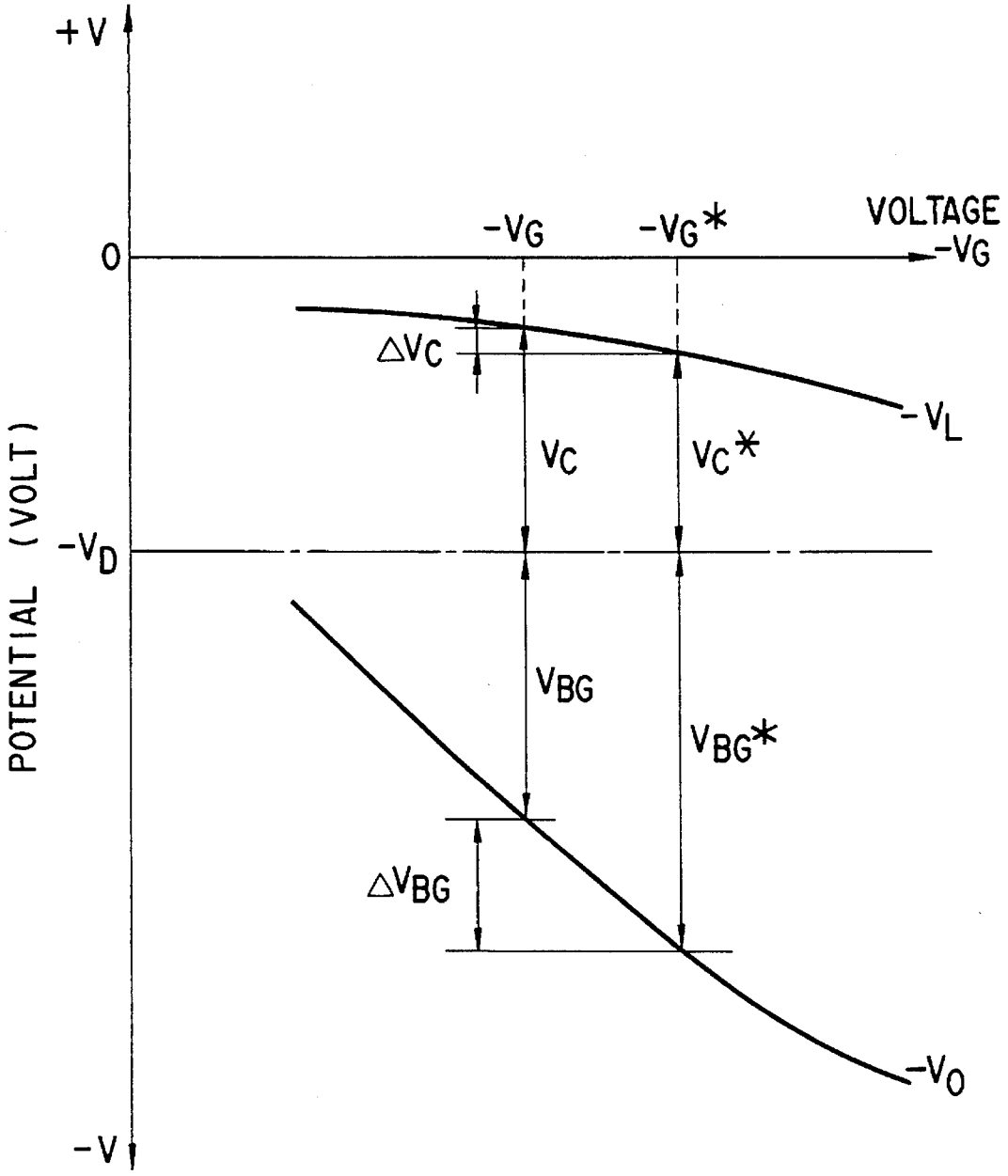
FIG. 6 is a graph showing a potential of an unexposed section of the photoconductive drum in connection with a grid bias voltage of a main charging unit, and that of an exposed section, and a developing bias voltage.

FIG. 6 shows a surface potential $V_O$ (potential of unexposed area) of the photoconductive drum 1 to an absolute value $V_G$ (grid bias voltage) of the grid bias voltage outputted from the grid screen 33 of the charger 2, a surface potential $V_L$ (potential of exposed area) of the photoconductive drum 1 damped by exposing its entire surface by a constant amount of light through the laser exposer 13, and a developing bias voltage $V_D$ (shown by a one dotted chain line), respectively.

In this embodiment, the polarity of the voltage is negative because of reversal.

If the grid bias voltage $V_G$ increases, the absolute value of the potential $V_O$ of the unexposed area and that of the potential $V_L$ of the exposed area decrease, respectively. If the potential $v_L$ of the exposed area to the grid bias voltage $V_G$ and the potential $V_O$ of the unexposed area to the grid bias voltage $V_G$ are linearly approximated, these relations can be expressed by the following equations (1) and (2):

$$V_O(V_G)=K_1 \cdot V_G+K_2 \quad (1)$$

$$V_L(V_G)=K_3 \cdot V_G+K_4 \quad (2)$$

wherein $K_1$ to $K_4$ are constants, $V_O$, $V_G$, $V_L$ are absolute values, $V_O$ (VG) shows density of $V_O$ to an arbitrary $V_G$, and $V_L$ ($V_G$) shows density of $V_L$ to an arbitrary $V_G$.

Figure 7:
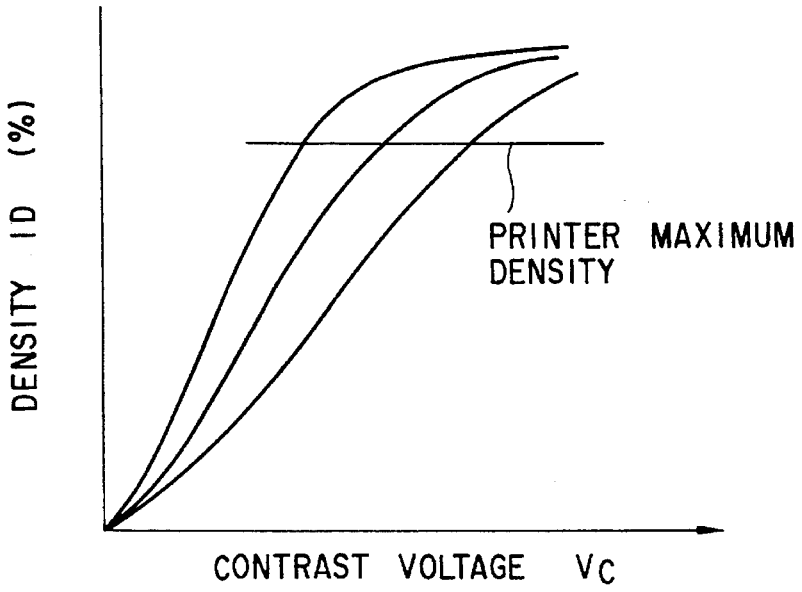
FIG. 7 is a graph showing image density of a solid area in connection with a contrast voltage.
Figure 8:
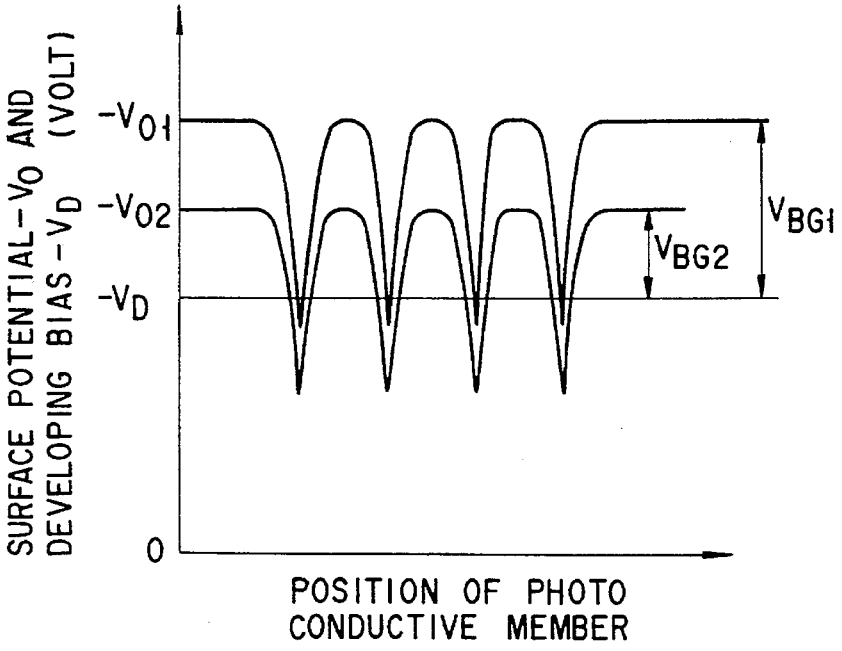
FIG. 8 is a graph showing the relationship among the potential of the unexposed section of the surface of the photoconductive drum, an image potential of a low density pattern, and a developing bias voltage.

Then, the developing density changes based on the relationship among the absolute value $V_D$ of the developing bias voltage, the potential $V_L$ of the exposed area, and the potential $V_O$ of the unexposed area. It is assumed that a contrast voltage $V_C$ and a background voltage VBG are defined as follows:

$$V_C=V_D(V_G)-V_L(V_G) \quad (3)$$

$$V_{BG}=V_O(V_G)-V_D(V_G) \quad (4)$$

wherein $V_D$ ($V_G$) shows that density of $V_D$ to an arbitrary $V_G$, the contrast voltage $V_C$ relates particularly to the density of the solid area (FIG. 7), and the background voltage $V_{BG}$ relates density of the low density area in a multi-gradation system using a pulse width modulation (FIG. 8).

Figure 9:
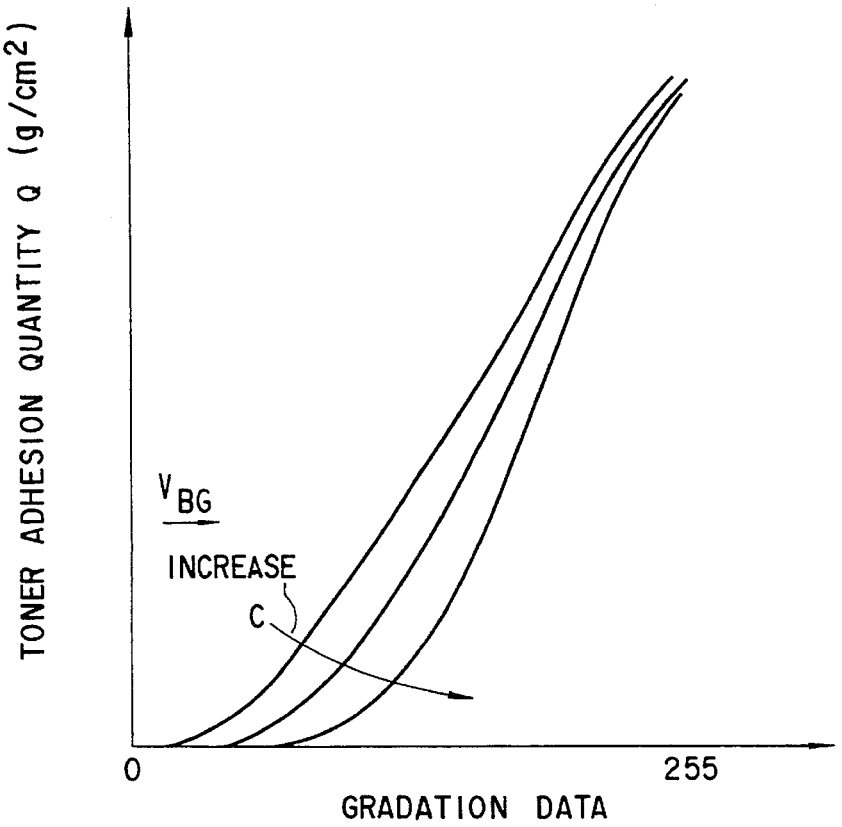
FIG. 9 is a graph showing an amount of toner adherence in connection with gradation data when a background voltage is increased.

FIG. 9 is quantity Q of toner adhesion to gradation data when density of the background voltage $V_{BG}$ is increased. The low density area is changed in a direction of an arrow C of the figure. Therefore, the developing density can be changed by these contrast voltage $V_C$ and the background voltage $V_{BG}$.

Here, the following equations are obtained from the above equations (1) to (4):

$$V_G\,(V_C,\,V_{BG})=(V_C+V_{BG}-K_2+K_4)\,/\,(K_1-K_3) \quad (5)$$

$$V_D\,(V_{BG},\,V_G)=K_1\cdot V_G+K_2-V_{BG} \quad (6)$$

From the above equations (5) and (6), the contrast voltage $V_C$ and the background voltage $V_{BG}$ are determined when the relationship ($K_1$ to $K_4$) between the grid bias voltage $V_G$ and the potential $V_L$ of the exposed area and the potential $V_O$ of the unexposed area is well-known. Thereby, the grid bias voltage $V_G$ and the developing bias voltage $V_D$ are univocally determined.

In other words, the surface potential of the photoconductive drum 1 is measured in advance, thereby obtaining the relationship (K1 to K4) between the grid bias voltage VG and the potential VL of the exposed area and the potential VO of the unexposed area. Thereafter, the contrast voltage VC and the background voltage VBG are set. From the equations (5) and (6), the grid bias voltage VG and the developing bias voltage VD are univocally determined. Under this condition, a plurality of density patterns is image-formed, and quantity Q of toner adhesion after developing is measured. Sequentially, the measured value and the reference value set in advance are compared with each other, correction value $\Delta V_C$ and $\Delta_{BG}$ of the contrast voltage $V_C$ and the background $V_{BG}$ can be respectively inferred from a deviatio $\Delta Q$.

As a result of the above inference, the grid bias voltage $V_G$, and the developing bias voltage $V_D$ are set again, and the quantity of toner adhesion of the density pattern is measured. These operations are repeated till these values are set to be in the allowable range.

The following will explain the measuring device 8 for measuring the toner adhesion quantity in detail.

Figure 10:
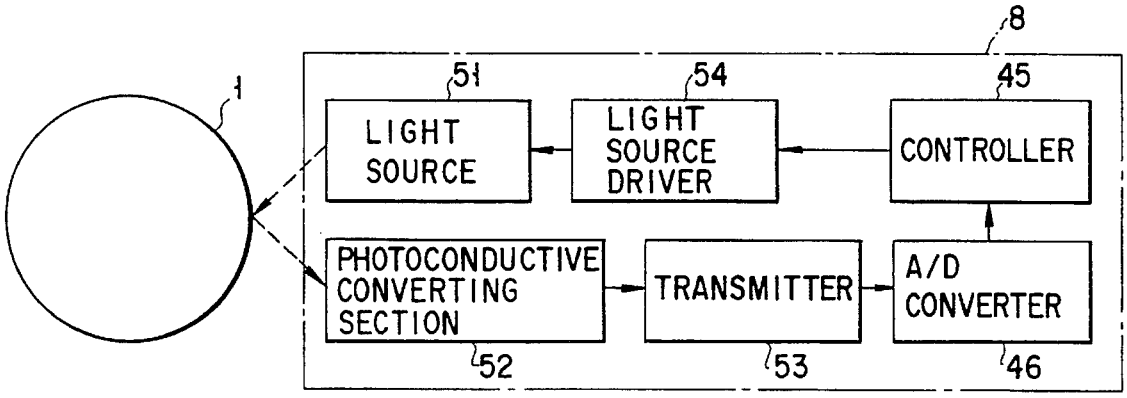
FIG. 10 is a block diagram showing the structure of the measuring unit of toner adhesion quantity.

FIG. 10 shows the structure of the measuring device 8 for measuring the toner adhesion quantity.

In FIG. 10, light, which is emitted from a light emitting diode (LED) 51, is radiated on the surface of the photoconductive drum 1. The reflected light is converted to a current by a photoelectric converter 52 in accordance with the quantity of the reflected light, and further current/voltage converted. Thereafter, the converted voltage is transmitted to the A/D converter 46 by a transmitter 53 to be converted to a digital signal, and fetched to the controller 70.

LED 51 is current-driven by a light source driving circuit 54. The light source driving circuit 54 is on/off-controlled by the controller 70, or controlled by a signal, which adjusting the quantity of driving current to the LED 51.

According to the above-mentioned structure, an operation of a printer apparatus will be explained with reference to flow charts of FIGS. 11, 12A and 12B.

Figure 11:
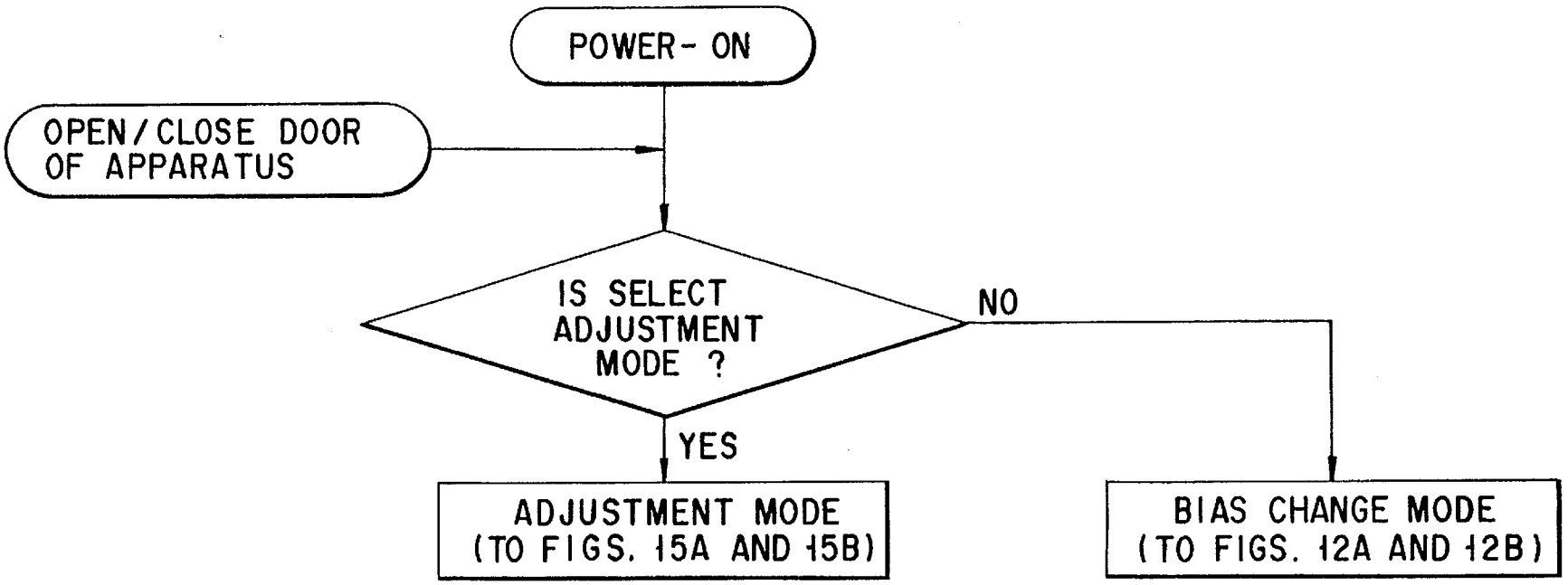
FIG. 11 is a flow chart for explaining a processing operation selection of a bias change an adjustment (calibration) mode.

In FIG. 11, after a main switch (not shown) of the printer apparatus is turned on, it is selected whether or not the control mode is started by the control panel 74.

When the control mode is selected by the control panel 74, the control mode is started in accordance with FIGS. 15A through 15C to be explained later. The following will explain the case in which the control mode is not selected, that is, bias change mode with reference to FIGS. 12A and 12B.

The bias change mode constitutes a warm-up step, a test pattern image-forming step, an adhesion quantity detecting step, a discriminating step, and a bias change step.

In the warm-up step, when power is supplied, an initial sequence of various apparatuses or units having a printer apparatus is performed through a CPU 64 based on an initial operation pattern stored in the memory section 61. In this case, the fixing unit 27, which needs relatively much time to perform the warm-up, is warmed up prior to the initial sequence of the other apparatuses or units. The initial sequence of the image-formation system including the cleaning operation is started when the warm-up is ended or the temperature is set to a predetermined temperature, which is lower than a predetermined reaching temperature obtained when the warm-up is ended.

By the initial sequence, the temperature of the photoconductive drum 1, the temperature and humidity of the inside of the apparatus, the developer stirring, and the characteristic of the photoconductive drum 1 due to charging and discharging are stabilized. Also, the surface of the photoconductive drum 1 are cleaned. As a result, the image forming environment, which is substantially the same as the normal image forming state (printing by a user based on image data), is set.

After the warm-up step is ended, it is checked whether or not the output of the measuring device 8 is normal through CPU 64. In other words, an output of a sensor in the adhesion quantity detecting step to be explained later is checked, and the presence of a sensor abnormal flag is confirmed. It is noted that the measuring device is discriminated as normality by being flag-cleared (reset) just after power is turned on.

In the case that the measuring device 8 is discriminated as abnormality state, which can provide the initial grid bias voltage value corresponding to a bias condition and the initial developing bias voltage value, is set through CPU 64 and maintained. Regarding the bias condition, the high voltage power supplies 35 and 44 can provide reference gradation characteristics of a reference temperature (ordinary temperature) and a reference humidity (ordinary humidity), which are stored in the memory section 61. In other words, the initial grid bias voltage value and the initial developing bias voltage value, which are read from the memory section 61, are D/A-converted by the D/A converters 47 and 48, respectively, and the converted output voltage control signal is outputted to each of the high voltage power supplies 35 and 44. Thereby, a predetermined grid bias voltage value and a predetermined developing bias voltage value are set by the high voltage power supplies 35 and 44. At the same time, a counter 62*a* for the number of times for controlling, a counter 62*b* for the number of printing paper, which are stored in the memory section 62, and a timer 63 for counting the stand-by time are cleared, respectively.

On the other hand, in the case that the measuring device 8 is discriminated as normality, the bias change mode is set through CPU 64 to guide the test pattern image forming step. In this case, the grid bias voltage value and the developing bias voltage value, which are set by the high voltage power supplies 35 and 44, are stored in the memory section 62 through CPU 64. It is noted that the memory section 62 stores the reference value, which is set in advance, is set after the power is turned on, and the bias value, which is set before the abnormality of the measuring device 8, at the other time.

In the test pattern image forming step, after the initial sequence is ended, the charging, exposing, developing, cleaning, and discharging processes are performed, similar to the normal image forming sequence. Thereafter, an image is formed based on the high density test pattern and the low density test pattern, which are generated by the pattern generator 38.

At this time, the predetermined grid bias voltage value of the charger 2 and the predetermined developing bias voltage value of the developing device 4 are set. These values are the bias condition, which can provide the reference gradation characteristics of a reference temperature (ordinary temperature) and a reference humidity (ordinary humidity).

In other words, CPU 64 reads output voltage control signals, serving as the initial grid bias voltage value and initial developing bias voltage value, from the memory section 61, and these signals are supplied to the high voltage power supplies 35 and 44 through the D/A converters 47 and 48.

In the exposing process, two test pattern latent images with predetermined sizes are are formed. The two test patterns correspond to two different gradation data and the test pattern having high density is a high density test pattern, and the test pattern having low density is a low density test pattern.

Regarding the sizes of the test patterns, a predetermined width is formed at the center of the image area in the axial direction of the photoconductive drum 1, and a predetermined length is formed in the rotational direction of the photoconductive drum 1. The width corresponds to the position in the axial direction of the photoconductive drum 1 of the measuring device 8, and is set to the minimum size such that no influence of edge effect, which is peculiar to the electronic photograph, onto the detection spot size. The length is set to the minimum size such that neither edge effect nor the response characteristic of the sensor has influence on the detection result.

The width is larger than the detection spot size by 1.5 to 5 mm, and the length is specified to the size, which is obtained by multiplying the detection spot size by the length corresponding to the movement of the surface of the photoconductive drum 1 and the number of times of detections, and by adding 1.5 to 5 mm thereto.

In the developing process, the developing roller 43 to which the initial developing bias voltage is applied, and two test pattern latent images are developed. Then, as shown in FIG. 5, two test pattern toner images having a different density are formed. In two test patterns, the test pattern area, which corresponds to low density gradation data, is called as a low density area, and the test pattern area, which corresponds to high density gradation data, is called as a high density area.

In the adhesion quantity detecting step, the quantity of reflected light of each of two test patterns is detected by the measuring device 8 by synchronizing with the point that two test patterns reach at the position opposite to the measuring device 8. Also, the measuring device 8 detects the quantity of reflected light of an undeveloped area of the photoconductive drum 1 by a predetermined timing. The quantity of the reflected light of the undeveloped area, the quantity of the reflected light of the low density area, and the quantity of the reflected light of the high density area are supplied to CPU 64 through the A/D converter 46. CPU 64 discriminates whether or not the quantity of the reflected light of the area other than the test pattern to be supplied from the A/D converter 46, the quantity of the reflected light of the high density area, and the quantity of the reflected light of the low density area are within the predetermined range, which is between the upper and lower limit values read from the memory section 61, respectively.

As a result of the discrimination, if either one of areas is out of the predetermined range, CPU 64 discriminates that the output value of the measuring device 8 is abnormal, sets the flag in the memory section 62, and controls such that abnormality state of the output value of the measuring device 8 is displayed in the control panel 74. Sequentially, the developing value, which is before the above executed bias change mode is set, and the grid bias value are read from the memory section 62, and each of the grid bias voltage supply 35 and the developing bias voltage supply 44 are controlled to be set in a stand-by state.

In a case that the output value of the measuring device 8 is normal, CPU 64 discriminates the calculation result of a predetermined function relating to an optical reflection rate against the low and high density areas of the amount of the reflected light of the nondeveloped area, which is supplied from the A/D converter 46, is used as a reference. Then, CPU 64 sets the calculation result as the toner adhesion quantity of the low density area and that of the high density area.

The comparison between the predetermined target value, which is set in the memory section 61, and the quantity of toner adhesion of the high density area, and the comparison between the predetermined target value, which is set in the memory section 61, and the quantity of toner adhesion of the low density area are respectively made by CPU 64. Then, the deviation of the high density area and that of the low density area are respectively calculated.

Then, the discrimination step is introduced to discriminate whether or not each of the calculated deviation of the high density area and that of the low density area is within the range of the predetermined standard value. If each of the deviation of the high density area and that of the low density area is within the range of the predetermined standard value, the counter **62*a* for the number of times for controlling, the counter 62*b* for the number of printing paper, which are stored in the memory section 62, and the timer 63** for counting the stand-by time are cleared, respectively, thereby obtaining a stand-by state in which printing can be performed in accordance with the user's request.

Moreover, in a case that at least one of deviations is out of the range of the standard value, the operation goes to the bias change step. The bias change step is performed to obtain the grid bias voltage value to be changed and the developing bias voltage value in order to set such a deviation to be in the standard range.

The bias change step is divided the following three small steps:

(1) The quantity of change of the potential relationship, which is expressed by two parameters, is determined from the relationship between both deviations.

(2) The bias value to be changed is calculated from the changed potential relationship and the function including a coefficient showing the surface potential characteristic of the photoconductive drum 1, which is prepared in advance.

(3) The grid bias and the developing bias are respectively set to the change value, which is calculated by the predetermined timing.

The above-mentioned steps are prepared to obtain the correction with high precision to consider the following disadvantage:

Specifically, according to the method in which the developing bias voltage value and the grid bias voltage value are directly selected from the lookup table, which are specified in advance, based on the deviation of the high density area and that of the low density area, the quantity of the change of the bias differs. That is, the quantity of the change of the bias differs, depending on the use of the photoconductive drum 1, the use of the developing unit, time when no image forming is performed, and the individual difference between the apparatuses. Due to this, the converging value of the quantity of control of each of the developing bias voltage and the grid bias voltage easily deviates from the target value in the state that the environment where the apparatus is mounted changes or the developing characteristic changes with the passage of time. It is noted that, in the present invention, speed-control data, which is based on the quantity of change of the contrast voltage and that of the background voltage, is used as data to be stored in the lookup table.

The effect of the potential change does not independently act on the high density area and the low density area. The effect can mutually act on both areas. This means that the correction cannot be surely made by determining only the respective bias values from the respective deviations.

Due to this, the quantity of the potential to be changed, which is expressed by two parameters based on the relationship between the deviation of the high density area and that of the low density area, is selected from the LUT (Look-up Table), which is set in advance.

One parameter is the contrast voltage, which shows the voltage between the potential of the exposed portion, which is the surface potential of the developing position when the whole surface exposure is performed by the predetermined quantity of exposure and the developing bias voltage. The other parameter is the background voltage between the potential of the unexposed portion, which is the surface potential of the developing position when no exposure is performed after charging. The change of the contrast voltage largely acts on the high density area, and that of the background voltage largely acts on the lower density area.

Figure 13:
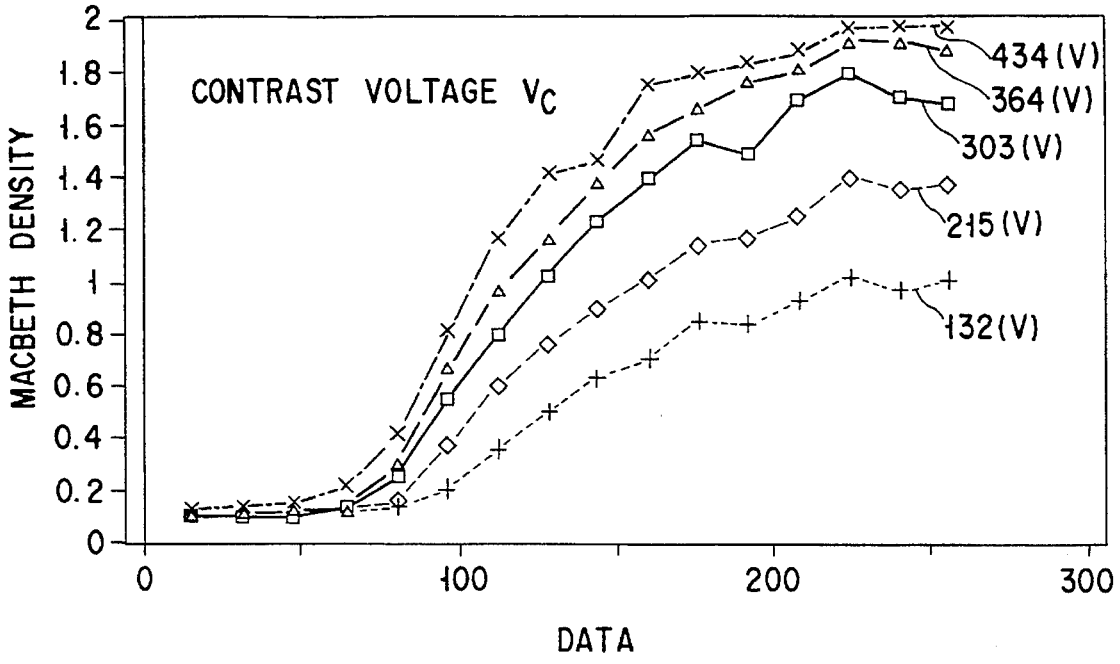
FIG. 13 is a graph showing the change of gradation reproduction when a contrast voltage is changed.
Figure 14:
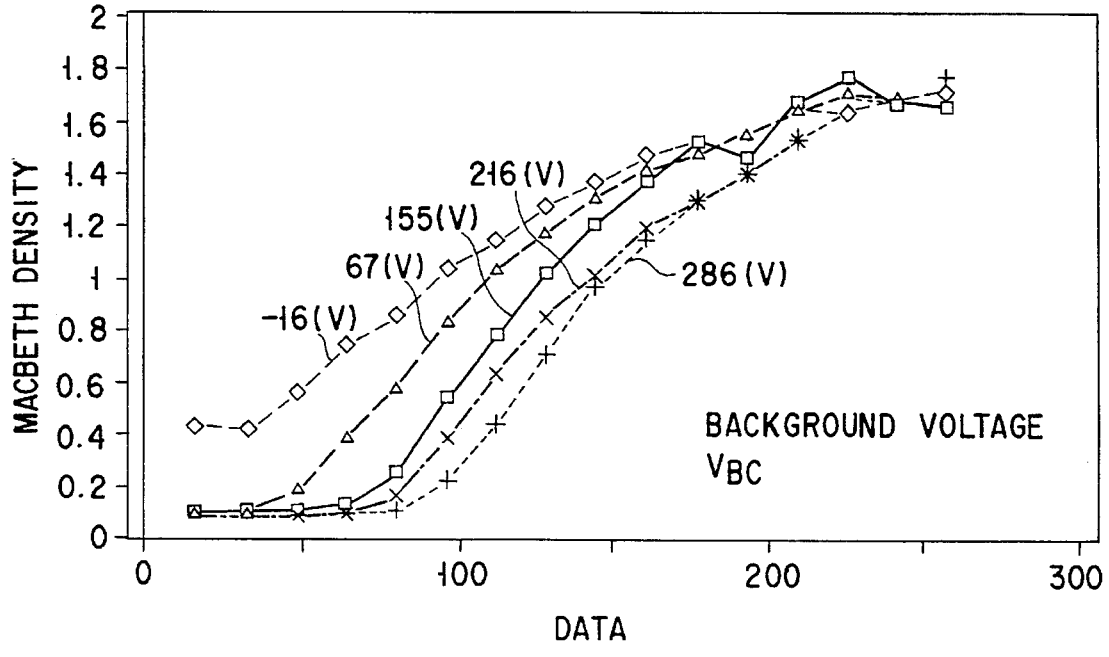
FIG. 14 is a graph showing the change of gradation reproduction when the background voltage is changed.

FIG. 13 shows the relationship between gradation data and an output image density, and more specifically shows the change of the gradation characteristic when the contrast voltage is changed. Similarly, FIG. 14 shows the change of the gradation characteristic when the background voltage is changed. The change of the contrast voltage and that of the background voltage act on the high density area and the low density area, respectively. Also, these changes can mutually act on both areas.

Therefore, the table containing the quantity of the change of the contrast voltage is prepared in the memory section 61 based on the relationship between the deviation of the high density area and that of the low density area. Also, the table containing the quantity of the change of the background voltage is prepared in the memory section 61 based on the relationship between the deviation of the high density area and that of the low density area. In this way, the quantity of the change of the contrast voltage and that of the background voltage are introduced from the deviations of the high and low density areas.

In the content of each table, the interaction between the contrast voltage and the background voltage is considered, and an effective voltage change can be suitably performed based on the relationship between both deviations. Moreover, since each quantity of change is set to 0 when both deviation is 0, the steadystate deviation after convergence is near 0.

Sequentially, a new contrast voltage and a new background voltage are obtained from the quantity of change of the contrast voltage and that of the background voltage, which are defined by the above-mentioned method, and the contrast voltage and the background voltage which are obtained when the test pattern is image-formed. Since the contrast voltage and background voltage are simply the parameters showing the relationship of the voltage, the grid bias voltage value and the developing bias voltage value, which can provide the relationship of the voltage, can be calculated.

In this case, the grid bias voltage value and the developing bias voltage value can be univocally obtained by equations (5) and (6), that is, the function stored in the memory section 61.

The above-obtained new grid bias voltage value and developing bias voltage value are changed to the output control values of the high voltage power supplies 35 and 44, respectively.

In a case that the test pattern is image-formed again, the grid bias voltage value and the developing bias voltage value are changed by the predetermined timing, respectively.

Two test pattern latent images are formed again on the photoconductive drum 1, which is charged by the grid bias voltage, which is changed by the test pattern image forming, detection and discrimination. Each test pattern latent image is developed by the changed developing bias voltage. Sequentially, the quantity of toner adhesion of the developed two test patterns is detected and discriminated in the toner adhesion quantity detecting step and the discrimination step.

If the discrimination step, if the deviation of the high density area and that of the low density area are within the standard range, the stand-by state is set after the cleaning operation in a state that the changed grid bias voltage value and developing bias voltage value are maintained. If at least one of the deviations is not within the standard range, the bias change, pattern image-forming, detection, and discrimination are repeated.

Therefore, the table containing the quantity of the change of the contrast voltage is prepared in the memory section 61 based on the relationship between the deviation of the high density area and that of the low density area. Also, the table containing the quantity of the change of the background voltage is prepared in the memory section 61 based on the relationship between the deviation of the high density area and that of the low density area. Thereby, the quantity of the change of the contrast voltage and that of the background voltage are introduced from the deviations of the high and low density areas.

In this way, at the time when the apparatus is mounted, the photoconductive drum 1 is exchanged, developer is exchanged, the toner adhesion quantity measuring unit 8 is cleaned, the toner adhesion quantity measuring unit 8, the optical system is adjusted, the optical system is exchanged, and the developing characteristic is changed, the target value and the control standard value of each of the toner adhesion quantity of the high density area, that of the low density area are automatically calibrated by the system. Thereby, the individual difference of the parts, the variation of the attaching position, and the change of the detection accuracy of the toner adhesion measuring device 8 are absorbed, and each device can be suitably controlled.

Figure 15A:
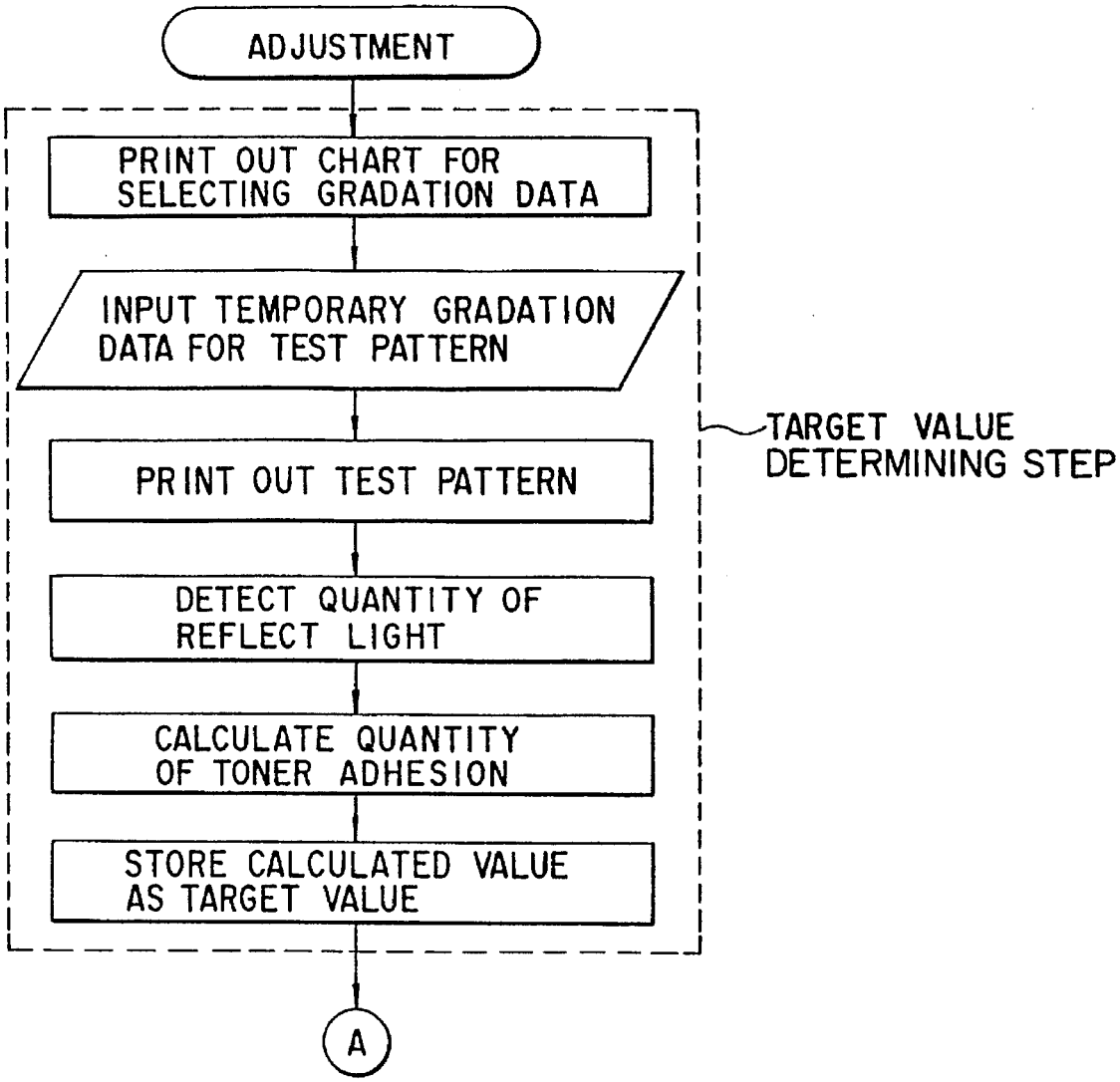
FIGS. 15A through 15C are flow charts for explaining calibration.
Figure 15B:
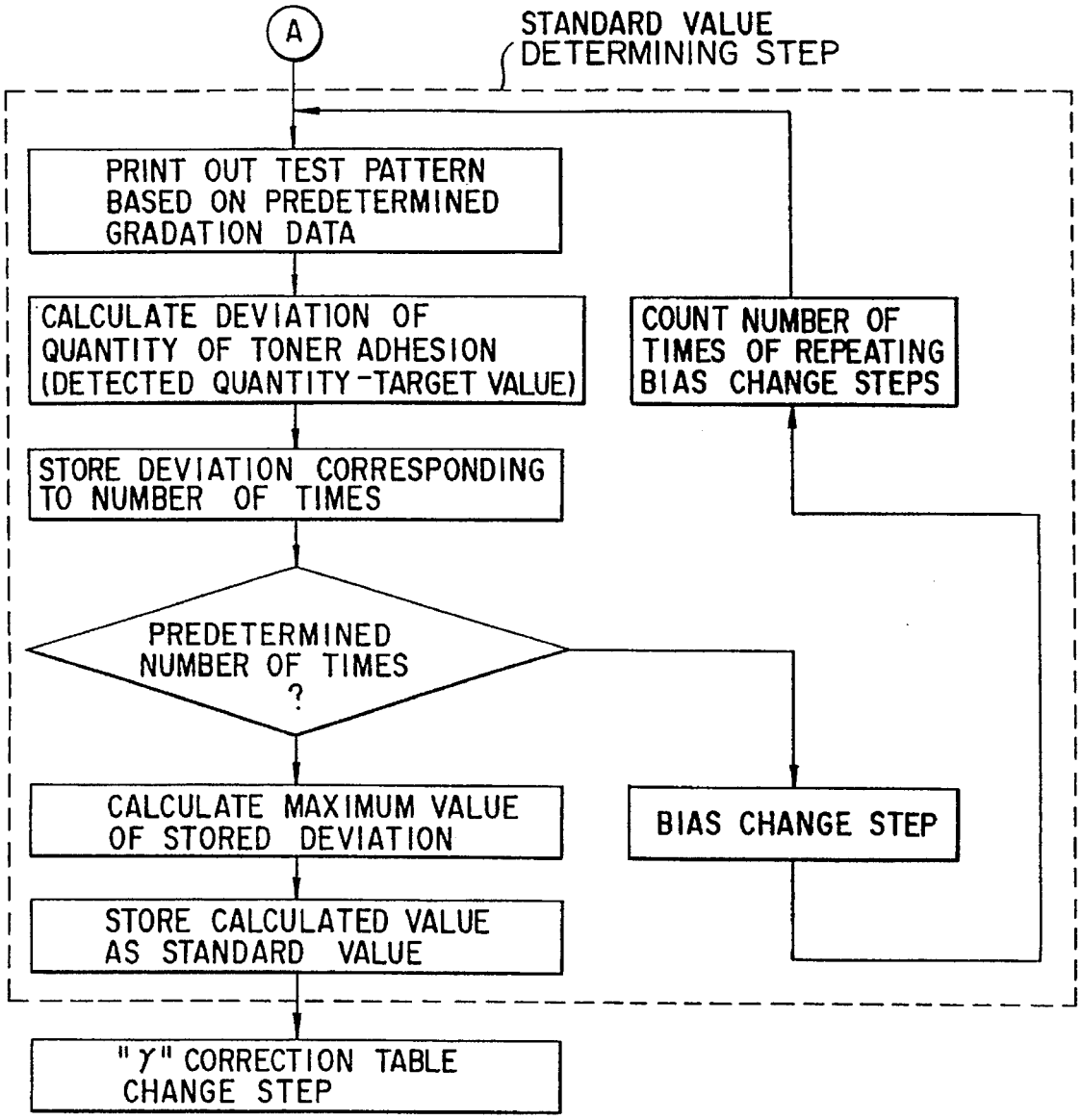
Figure 15C:
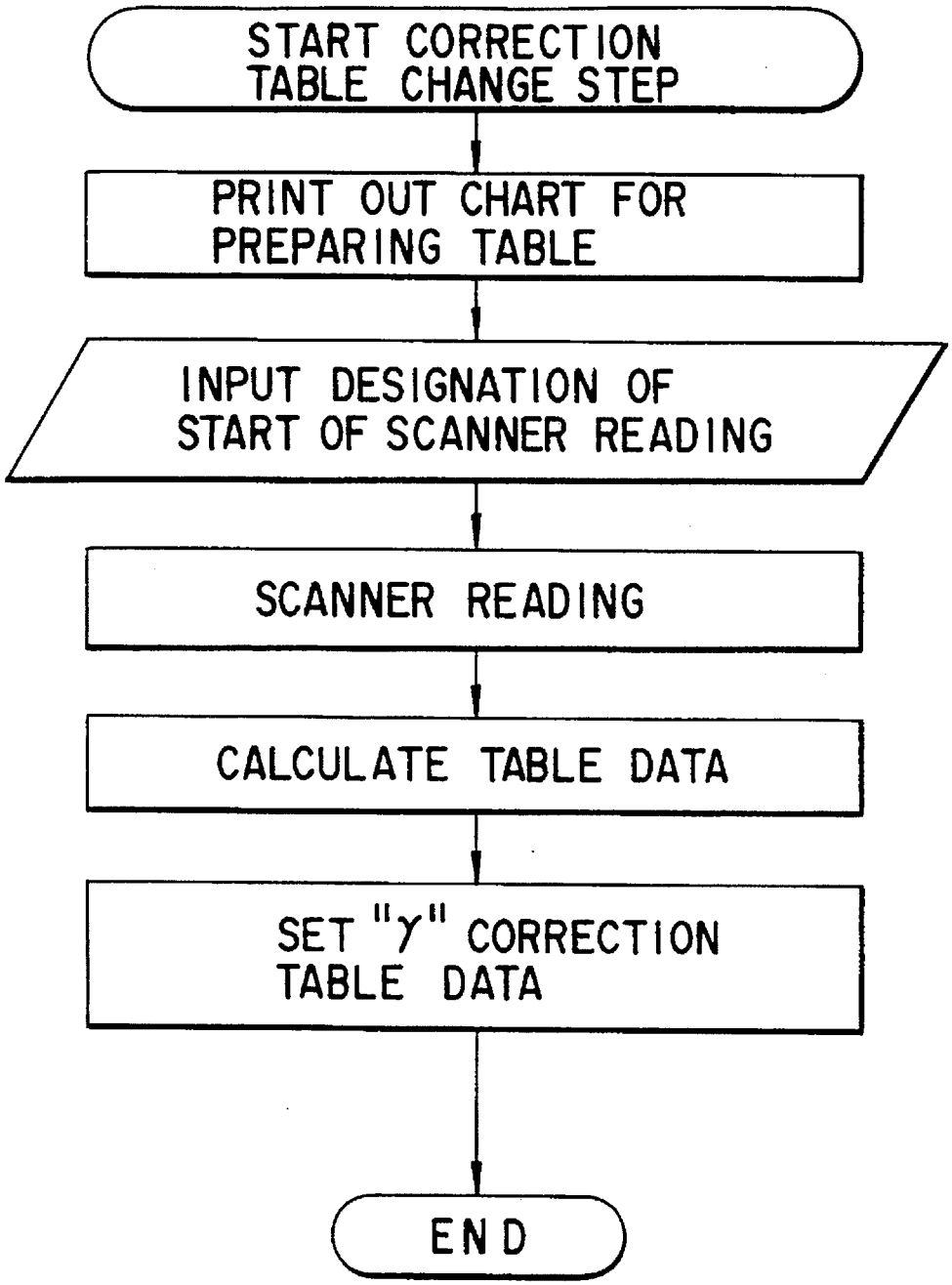

The following will explain the control mode with reference to FIGS. 15A through 15C.

The control mode includes a target value determining step, a standard value determining step, and a γ (gamma)-correction table change step, which changes the γ-correction table when the deviation value determined by the standard value determining step is over a predetermined value.

As explained above, the full colored laser beam printer has the γ (gamma) correction section 78 as means for γ-correcting the gradation characteristic of input image data (including gradation data) or that of output image data, which is sent from the image reader unit 71, and that of pulse width data, which is actually exposed.

Therefore, the target value or the control standard value is set by γ correction of y correction section 78, i.e., color correction under the initial standard imageforming condition.

Gamma (γ) correction is performed under the condition close to the reference image-formation, thereby the gradation characteristic of input image data or that of output image data is set to the reference gradation characteristic. However, the correction is made by false-gradation-processing using false gradation processing section 79. Due to this, if all gradation characteristics including the temperature, humidity, the passage of time, etc., are corrected by only γ-correction, unfavorable influence such as generation of texture may be exerted.

Also, in order to deal with the gradation characteristic (developing characteristic), which largely changes non-linearly by the reference image forming environment and the passage of time, it is necessary to provide a large number of gradations (the number of pulse width modulations) for correction, which are selectable.

Therefore, image data obtained by the γ-correction must be corrected such that the control target value and the control standard value can be set and an ideal image forming condition can be obtained.

In FIGS. 15A through 15C, in the case that the adjustment (calibration) mode is designated from the control panel 74, the target value determining step is, first, started.

Figure 16:
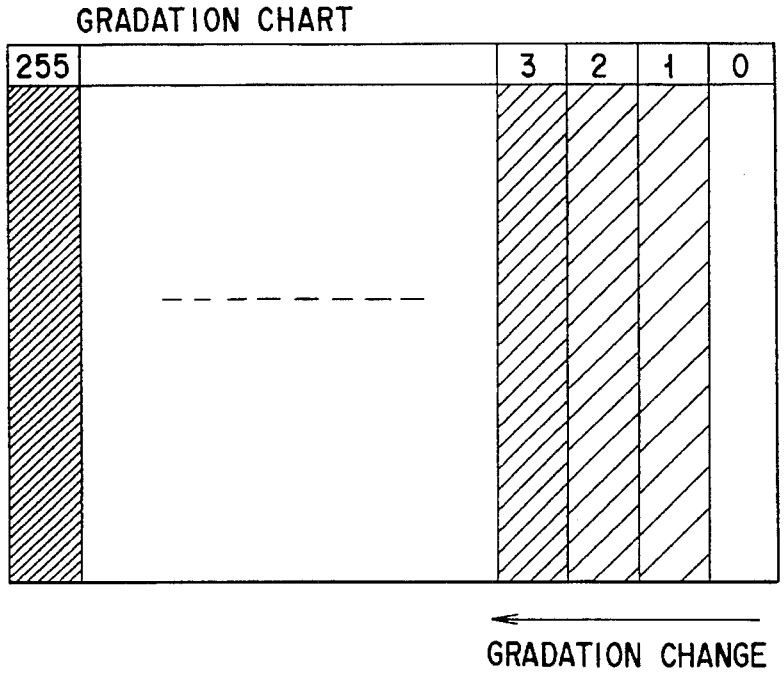
FIG. 16 is a schematic view showing one example of an output of the gradation reproduction chart.

In other words, pulse width modulation data corresponding to the gradation chart of each gradation and font data corresponding to the number of gradations are read, read pulse width modulation data is outputted to the laser driver 37, and the gradation chart for setting the image forming condition is printed. More specifically, the semiconductor laser element of the laser exposer 13 is drive by the laser driver 37, laser beams having a plurality of light density corresponding to the gradation chart, and font data for the number of gradations are exposed. Sequentially, the exposed image is developed, transferred to the sheet of paper, and fixed. In other words, the gradation chart in which the gradation pattern image and the number of gradations are printed out is outputted as shown in FIG. 16.

Sequentially, gradation data of a temporary test pattern for outputting the test pattern is inputted by a user. More specifically, the gradation pattern image formed on the gradation chart is compared with the pattern density chart of the standard high density area of the density image chart, which is set in advance. Also, the gradation pattern image is compared with the pattern density chart of the standard low density area of the density image chart. As a result, as pulse width data of the temporary test pattern and gradation data, the number of gradations (the number of pulse widths), which is closest to the standard pattern density, is inputted from the control panel 74.

In this case, as gradation data for control, gradation data, which is not passed through the γ correction section 78 and the false gradation processing section 79, is used. Moreover, regarding the test pattern, which is used for normal control, the gradation pattern and test pattern, which are used at the time of calibration, one pattern (patch) corresponds to one type of pulse width data.

Thereafter, the temporary test pattern is printed based on gradation data of the temporary test pattern, and the quantity of reflected light of the photoconductive drum 1 are measured, and the quantity of the toner adhesion provided to the temporary test pattern is calculated. The calculated quantity of the toner adhesion is stored in the memory section 62 as a target value.

Secondary, when the target value is specified, the standard value discrimination step is started.

The target value and the control standard value are started to be read by the operation of the control panel 74.

More specifically, predetermined gradation data, which is different from the temporary test pattern used in the target value discrimination step, is read from the memory section 61, and the test pattern is formed based on read gradation data. In this case, it is needless to say that the test pattern having two corresponding gradation data is formed and developed, similar to FIGS. 12A and 12B already explained.

Then, the quantity of toner adhesion formed on the photoconductive drum 1 based on the test pattern is calculated, and the difference between the target value and the calculated quantity of toner adhesion, that is, the deviation is obtained. Thereafter, the measured quantity of toner adhesion of the low density area and that of the high density area are stored in the memory section 62 as the deviation corresponding to the number of time of the pattern formations.

Then, the control standard value for the stored target value is set. In other words, based on two pulse width data (one for low density area and the other for high density area) serving as a basis for setting the control standard value, the test pattern having two corresponding gradation data is formed and developed, and the quantity of toner adhesion supplied to the test pattern is calculated, similar to FIGS. 12A and 12B already explained. Then, the bias change step is executed in accordance with the obtained quantity of toner adhesion, similar to FIGS. 12A and 12B. In this case, the number of times of the repetitions of the bias change steps is stored in the memory section 62.

Figure 12A:
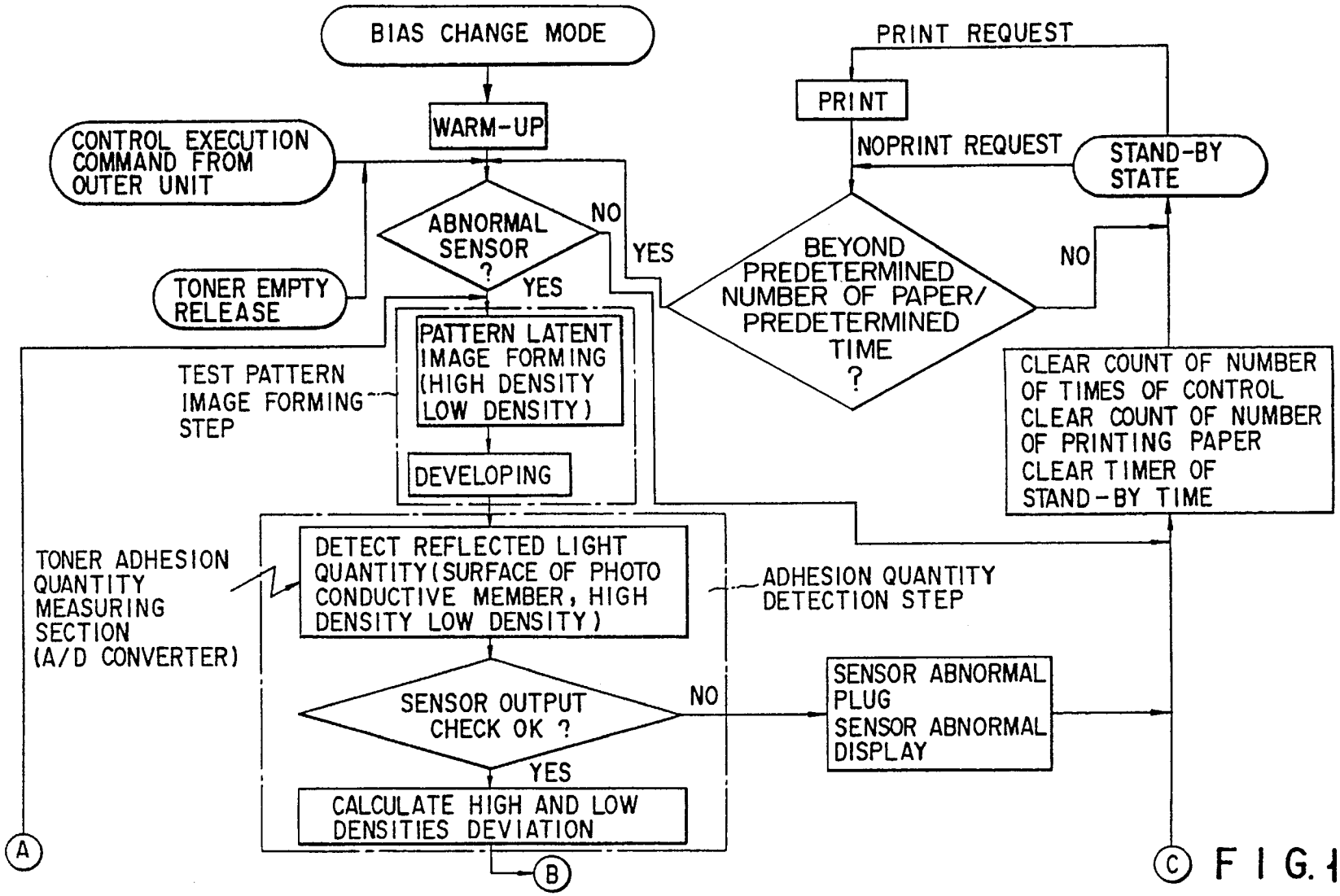
FIGS. 12A and 12B are flow chart for explaining a processing operation of a bias change mode.
Figure 12B:
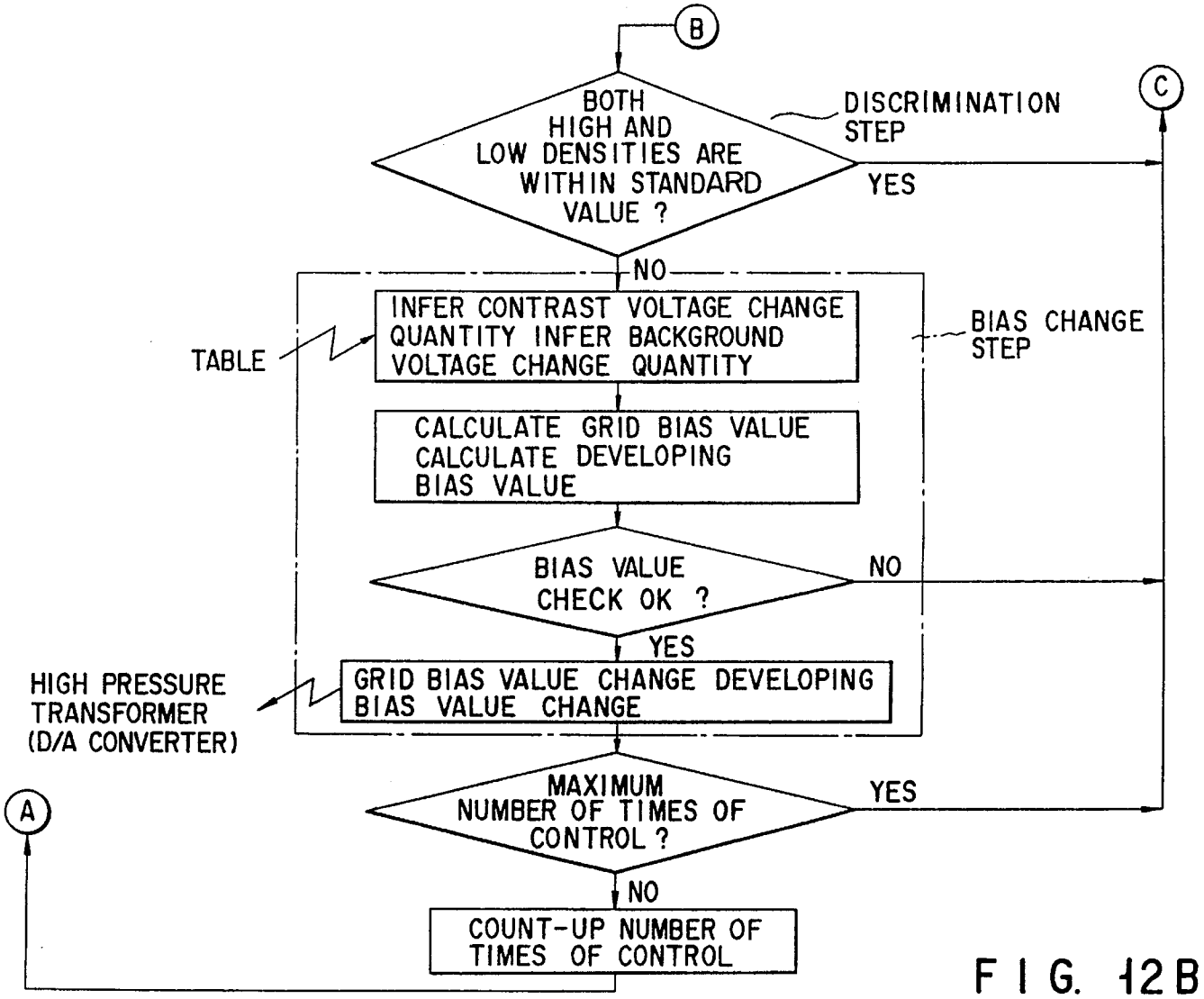

The processing for counting up the number of times of control are performed in the same steps as shown by the flow chart of FIGS. 12A and 12B. However, in the normal control, at the time when the deviation of the high density area and that of the low density area are respectively within the control standard value, the repetition of the bias change step is stopped. In the control mode, the bias change step is repeated until the predetermined number of times, which is set in advance, is reached. In other words, the bias change step is repeated until the number of times for control the predetermined control standard value, which is different from the maximum number of times for normal control, is obtained. At this time, the maximum value to the absolute value of the deviation of each of the high density area and the low density area is stored in the memory section 62.

After the bias change step for setting the control standard value is repeated the predetermined number of times, the value, which is obtained by multiplying each maximum value of the high density area and low density area by the predetermined coefficient, is stored in the memory section 61 as the control standard value of the high density area and that of the low density area.

In this embodiment, in the normal control, the maximum number of times of control is 3 to 10. In reading the control standard value, the maximum number of times of control is 5 to 20. Thereby, the control standard value can be set to the value in accordance with the steady-state deviation in the actual control system. Also, the value, which is obtained by multiplying the maximum value of each deviation by the predetermined coefficient ranging from 1.0 to 2.0, is used as a control standard value.

Figure 17:
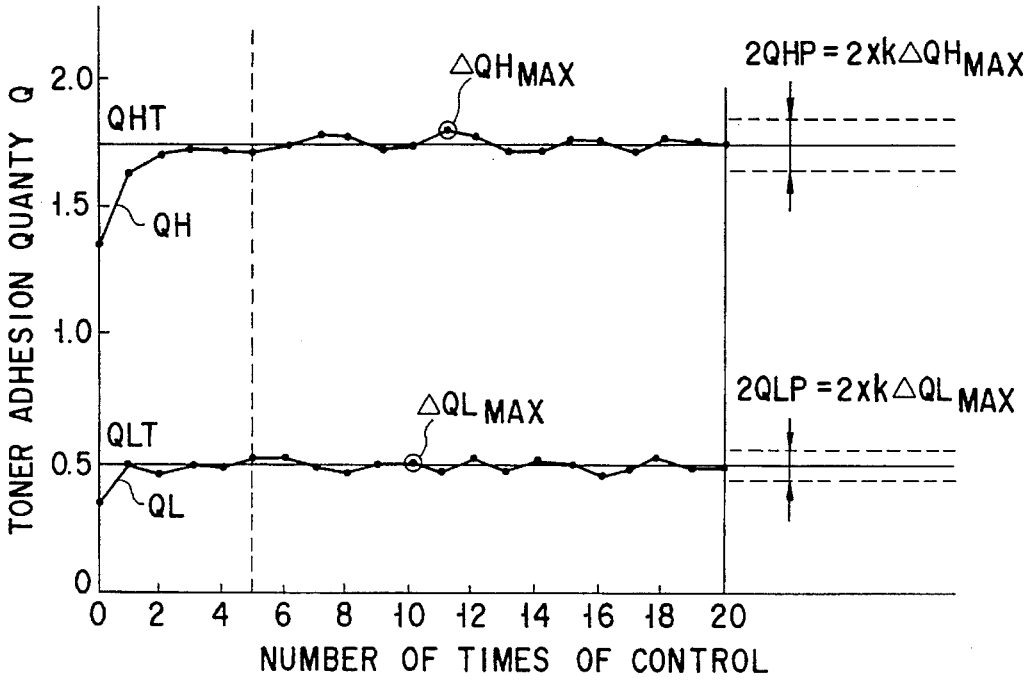
FIG. 17 is a graph showing the change of the toner adhesion quantity, which is an input of a measuring system in the control process.

FIG. 17 shows an example in which both toner adhesion quantity QH of the high density area under the environment having low temperature, low humidity and toner adhesion quantity QL are lower than the respective target values QHT and QLT. In this figure, a horizontal axis is a number of times of control, and a vertical axis is a detection value of toner adhesion quantity.

In the discrimination step, the maximum number of times of control for setting the control standard value is set to be 20. Since, in the normal control, the maximum number of times of control is 5, the maximum number of times of control for the steady-state deviation is set to 16, and the maximum deviation of all steady-state deviation (absolute value: Δ QHmax, Δ QLmax) is extracted. Then, the values, which are obtained by multiplying the maximum deviation by the predetermined coefficient k, are renewed and stored in the memory section 61 as control standard value QHP and QLP, respectively.

Therefore, after the normal control is ended, the converging value of the toner adhesion quantity QH of the high density area is within 2QHP of the target value QHT±control standard value QHP. The converging value of the toner adhesion quantity QL of the low density area is within 2QLP of the target value QLP±control standard value QLP.

The bias change step is repeated the predetermined number of times and the control standard value of the high density and that of the low density area are determined. Thereafter, the γ correction table change step is started. As already explained, the γ correction must be made after the control target value and the control standard value are set, and the environment to be controlled is set to the ideal image forming condition. Therefore, the γ correction table is changed within the range of the control standard value of the high density area and that of the low density area defined by the target value discrimination step and the standard value discrimination step. Thereby, the reference image forming environment or the developing characteristic, which largely changes linearly with the passage of time is maintained to have a reference gradation characteristic.

In other words, in the γ-correction table change step, a test pattern for changing the γ-correction (gradation reproduction) table is printed under the bias conditions (grid bias, developing bias), which are set when the standard value discrimination step is started.

The test pattern for γ-correction is used to set the gradation characteristic of the entire system, which is from the image reader unit 71 to the laser beam printer unit 73 of the image forming apparatus, to the reference characteristic by use of the γ correction section 78. Pattern data for γ-correction, which is prepared in advance, is transferred to the pseudo gradation processing section 79 by CPU 64, and data is held. When test pattern for γ-correction is inputted to the false gradation processing section 79, converted to pulse width modulation data, and outputted to the laser driver 37.

Unlike pattern of the gradation chart, one type of pattern (patch) of the gradation patterns is a set (synthesis) of a plurality of pulse data, depending on the false-gradation-processing. In other words, the latent image of the gradation pattern including the characteristic of the false gradation processing section is formed, developed, transferred, and fixed thereby obtaining the output image.

The output image is printed under the optimized image forming condition as possible in the reading process of the target value and the control standard value, but includes the change of the gradation characteristic, which cannot be optimized even by the change of the bias.

In other words, CPU 64 reads pulse width modulation data corresponding to the test pattern for γ-correction from the memory section 61, and outputs read pulse width modulation data for each gradation to the laser driver 37.

The semiconductor laser element of the laser exposer 13 is driven by the laser driver 37, and exposure corresponding to the test pattern is performed. Therefore, the exposed image is developed, transferred to the transferring paper, and fixed. Thereafter, the test pattern for γ-correction in which the gradation pattern image is printed is issued.

The issued test pattern for γ-correction is mounted on the original base of the image reader unit 71, and the γ-correction is instructed by the control panel 74.

Thereby, image data corresponding to the test pattern for γ-correction read by the image reader unit 71 is shading-corrected by the shading correcting section 76, and range-corrected by the range correcting section 77, thereafter image data is outputted to CPU 64. CPU 64 determines a density data value of the test pattern corresponding to the region, which is currently being scanned. Then, γ-correction image data is calculated based on the density data value and the density data value, which is read from the memory section 61 corresponding to the reading position of the test pattern. The calculated γ correction image data is renewed and stored in the memory section 61.

The above series of γ-correction is repeated a predetermined number of times for each region whose test pattern gradation is different. As a result, γ-correction image data corresponding to each gradation is set to the memory section 61.

As mentioned above, reading the target value and the control standard value, optimizing the image forming conditions, and γ-correction are performed in order, so that the gradation characteristic of the entire system can be set to an ideal reference characteristic. Moreover, gradation characteristic can be set at the minimum time due to automatization. Then, the image forming conditions of the environment and passage of time is controlled to be optimized based on the target value, control standard value optimized in the actual individual system, thereby the set reference gradation characteristic can be maintained.

Moreover, since the initialization and adjustment of the gradation reproduction such as γ-correction are performed after initializing and adjusting the image forming conditions such as the target value and control standard value, it is possible to adjust the gradation reproduction of the gradation characteristic under the image forming conditions having the optimized developing characteristic. Due to this, generation of texture can be prevented, and favorable expression of gradation can be ensured, and stability of the image can be maintained. Therefore, the gradation reproduction can be adjusted regardless of the individual difference between the apparatuses and the adjusting environment.

Also, since the target value and the control standard value are determined by initializing and adjusting the image forming conditions. Therefore, not only the target value but also the control standard value can be adjusted for each performance of the apparatus without using the special measuring device, and time necessary for maintenance can be reduced.

Furthermore, the target value and the control standard value of the toner adhesion quantity of the high density area on the photoconductive drum 1 and those of the low density area can be set at the same time by a series of the adjustment execution operation, and time necessary for maintenance can be reduced.

In the image forming apparatus having the false gradation processing section, the gradation chart, which is used to initialize and adjust the image forming conditions, does not include the γ-correction, and is not influenced by the false-gradation-processing. Moreover, the test pattern, which is used to initialize and adjust the gradation reproduction, does not include the γ-correction.

The above embodiment explained the case in which data corresponding to the gradation chart for image forming conditions is supplied to the laser driver of the trailing stage of the false gradation processing section and data corresponding to the test pattern for gradation reproduction is supplied to the false gradation processing section of the trailing stage of the γ-correction section. However, the present invention is not limited to the above embodiment. Both data corresponding to the gradation chart for image forming conditions and data corresponding to the test pattern for gradation reproduction may be supplied to the γ-correction section.

In the case of data corresponding to the gradation chart for image forming conditions, data is directly outputted to the laser driver from the γ-correction section outputs data. In the case of data corresponding to the test pattern for gradation reproduction, data is also directly supplied to the laser driver.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An image forming apparatus, comprising:

means for forming an image of a predetermined pattern on an image bearing member with developer having toner under a predetermined image forming condition;

means for detecting an amount of toner attached onto said image bearing member by said forming means;

first calculating means for calculating a deviation between the amount of toner detected by said detecting means and a reference value of the amount of toner attached to said image bearing member corresponding to said predetermined pattern;

first designating means for designating an adjusting mode to adjust the image forming apparatus;

first actuating means, in response to the designation of said first designating means, for actuating said forming means, said detecting means, and said first calculating means;

means for changing said image forming condition in accordance with the deviation calculated by said first calculating means;

first executing means for repeatedly executing processings of said forming means, said detecting means, said first calculating means, and said changing means at predetermined times;

second calculating means for calculating a reference range of a deviation for discriminating whether or not said image forming condition is changed, in accordance with the deviation calculated repeatedly by said first executing means;

means for storing the reference range calculated by said second calculating means;

second designating means for designating an image forming mode to form an image on said image bearing member;

second actuating means, in response to the designation of said second designating means, for actuating said forming means, said detecting means, said first calculating means and said changing means; and second executing means for changing the image forming condition when the deviation calculated by said first calculating means is larger than the reference range stored in said storing means so as to stabilize image density changes of the image formed on said image bearing member.

2. The apparatus according to claim 1, wherein said second executing means comprises first controlling means for detecting the amount of toner attachment by said detecting means when the image is formed on said image bearing member; second controlling means for comparing the amount of toner attachment detected by said detecting means with the reference value, and calculating the deviation therebetween by said first calculating means; means for discriminating whether or not the calculated deviation is within the reference range; third controlling means for changing the image forming condition by said changing means when it is discriminated that said deviation calculated by said calculating means is out of the reference range; fourth controlling means for repeatedly executing the processings of said first and second controlling means, and discriminating means under the image forming condition changed by said third controlling means; and means for ending the processing for changing said image forming condition when it is discriminated that the deviation calculated by said calculating means is within the reference range.

3. The apparatus according to claim 1, wherein said forming means comprises charging means for charging said image bearing member; means for radiating a light beam so as to form a latent image on the image bearing member charged by said charging means; means for developing the latent image formed on said image bearing member; first voltage applying means for applying a grid bias voltage to said charging means; and second applying means for applying a developing bias voltage to said developing means; and the image forming condition includes said grid bias voltage and developing bias voltage.

4. The apparatus according to claim 1, further comprising:

second storing means for storing a reference value of the amount of toner attachment corresponding to said predetermined pattern; and third storing means for storing the deviation calculated by said first calculating means.

5. The apparatus according to claim 4, wherein said second storing means stores a high density pattern substantially equal to a solid image and a low density pattern substantially equal to a half tone image, and a deviation of amount of toner attachment of the solid image and that of amount of toner attachment of the half tone image is obtained by said first calculating means.

6. The apparatus according to claim 5, wherein said second calculating means calculates a reference range of the deviation in accordance with the deviations obtained from at least both the high density pattern substantially equal to the solid image and the low density pattern substantially equal to the half tone image.

7. An image forming apparatus, comprising:

means for forming an image of a predetermined pattern on an image bearing member with developer having toner under a predetermined image forming condition;

means for detecting an amount of toner attached onto said image bearing member by said forming means;

means for calculating a deviation between the amount of toner detected by said detecting means and a reference value of the amount of toner attached to said image bearing member corresponding to the predetermined pattern;

means for designating an adjustment mode to adjust the image forming apparatus;

means for actuating, in response to the designation of said designating means, said forming means, said detecting means, and said calculating means;

first changing means for changing said image forming condition in accordance with the deviation calculated by said calculating means;

executing means for repeatedly executing processings of said forming means, said detecting means, said calculating means, and said changing means at predetermined times;

means for storing a translation table for providing a correction of gradation to image data corresponding to an image formed on said image bearing member; and second changing means for changing a value of the translation table stored in said storing means in accordance with the image forming condition finally changed by said changing means when the processing of said changing means is repeated executed by said executing means.

8. The apparatus according to claim 7, further comprising a second calculating means for calculating a reference range of a deviation for discriminating whether or not said image forming condition is changed in accordance with the deviation calculated by said executing means.

9. The apparatus according to claim 7, wherein said calculating means calculates the deviations of both the high density pattern substantially equal to the solid image and the low density pattern substantially equal to the half tone image.

10. The apparatus according to claim 8, wherein said second calculating means calculates a reference range of the deviation based on the deviations obtained from at least both the high density pattern substantially equal to the solid image and the low density pattern substantially equal to the half tone image.

11. An image forming apparatus, comprising:

first storing means for storing predetermined gradation data;

means for forming a pattern in accordance with said gradation data;

detecting means for detecting amount of toner attachment of the pattern;

second storing means for storing a reference value for calculating a deviation from the amount of toner attachment;

first calculating means for calculating the deviation from the amount of toner attachment and reference value;

third storing means for storing a discrimination reference for discriminating whether or not an image forming condition is changed from the deviation;

means for discriminating whether or not the image forming condition is changed in accordance with the deviation and a discrimination reference;

means for changing the image forming condition based on the discrimination result of said discriminating means and the deviation;

first designating means for designating a desirable gradation data;

fourth storing means for storing gradation data designated by said first designating means;

second designating means for designating the start of setting operation of the reference value and discrimination reference;

first setting means, operated in accordance with the designation of said second designating means, for forming a pattern corresponding to gradation data stored in said fourth storing means on an image bearing member under a predetermined image forming condition, detecting amount of toner attachment of the pattern, and storing the amount of toner attachment in said second storing means as a reference value; and second setting means for forming a pattern corresponding to predetermined gradation data stowed in said first storing means on the image bearing member, detecting amount of toner attachment of the pattern, calculating a deviation from the amount of toner attachment and a reference value, storing the deviation in fifth storing means, changing the image forming condition in accordance with the deviation, repeating the pattern forming, detecting, calculating, storing, and changing a predetermined number of times, calculating the discrimination reference in accordance with the deviation stored in said fifth storing means, and storing said calculated discrimination reference in said third storing means.

12. A method for forming an image, comprising:

a forming step for forming an image of a predetermined pattern on an image bearing member with developer having toner under a predetermined image forming condition;

a detecting step for detecting an amount of toner attached onto the image bearing member by said forming step;

a first calculating step for calculating a deviation between the amount of toner detected by said detecting step and a reference value of the amount of toner attachment corresponding to the predetermined pattern;

a first designation step for designating an adjustment mode to adjust the image forming apparatus;

a first operating step for operating, in response to the designation of said first designating step, said forming step, said detecting step, and said first calculating step;

a first changing step for changing the image forming condition in accordance with the deviation calculated by said first calculating step;

a repeating step for repeating the processings of said forming step, said detecting step, said first calculating step, and said changing step at predetermined times;

a second calculating step for calculating a reference range of a deviation for discriminating whether or not said image forming condition is changed, in accordance with the deviation calculated by said repeating step;

a storing step for storing the reference range calculated by said second calculating step;

a second designating step for designating an image forming mode to form an image on said image bearing member;

a second operating step for operating, in response to the designation of said second designating step, said forming step, said detecting step, and said first calculating step;

a third operating step for changing the image forming condition when the deviation calculated by said first calculating step is larger than the reference range stored in said storing step so as to stabilize image density changes of the image formed on said image bearing member.

13. A method for forming an image, comprising steps of:

forming an image of a predetermined pattern on an image carrier body by use of developer having toner under a predetermined image forming condition;

detecting an amount of toner provided to said image carrier body by said forming step;

calculating a deviation between the quantity of toner detected by said detecting step and a reference value of the amount of toner adhesion corresponding to said predetermined pattern;

designating means for designating a control mode to an image forming apparatus;

operating in response to the designation of said designation step, said forming step, said detecting step, and said calculating step;

changing the image forming condition in accordance with deviation calculated by said calculating step;

repeating the processings of said image forming step, said detecting step, said calculating step, and said changing step predetermined times; and changing a value of a translation table stored by said storing step in accordance with the image forming condition repeated by said repeating step and finally changed by said changing step.

14. A method for forming an image, comprising:

a detecting step of detecting amount of toner attachment of a pattern formed on an image bearing member;

a calculating step of calculating a deviation corresponding to a reference value in accordance with the detection result;

an image condition setting step of setting an image condition to change the image forming condition in accordance with said calculated deviation when the calculated deviation of said calculating step is over a discrimination reference range;

a first determining step of determining the reference value to be used for calculating the deviation of said calculating step;

a second determining step of determining said discrimination reference range to be used for discriminating whether or not the image forming condition is changed; and an operating step of operating said image condition setting step with the reference value and discrimination reference range obtained in said first and second determining steps.

15. The method according to claim 14, wherein said first and second determining steps are started at the time when an adjustment mode is set.

16. The method according to claim 14, wherein said first determining step includes a designating step of designating desirable gradation data for forming a pattern, a pattern forming step of forming the pattern corresponding to the designated gradation data on the image bearing member under a predetermined image forming condition, a detecting step of detecting the amount of toner attachment of the pattern, and a storing step of storing the amount of toner attachment in a storing means as a reference value.

17. The method according to claim 14, wherein said second determining step has a pattern forming step of forming a pattern on the image bearing member based on predetermined gradation data, a detecting step of detecting amount of toner attachment of the pattern, a first calculating step of calculating a deviation from the detected amount and the reference value determined by said first determining step, a deviation storing step of storing the deviation in a storing means, a changing step for changing an image forming condition in accordance with the deviation, a second calculating step of repeating said pattern forming step, detecting step, first calculating step, deviation step, and changing step a number of predetermined times and calculating a discrimination reference value defining based on each stored deviation, and a discrimination reference storing step of storing the calculated discrimination reference value to said storing means.

18. The method according to claim 14, wherein said image condition setting means includes a pattern forming step of forming a pattern on the image bearing member based on predetermined gradation data, a detecting step of detecting amount of toner attachment of the pattern, a first calculating step of calculating a deviation from the amount of toner attachment and the reference value determined by said first determined step, a discriminating step for discriminating whether or not the image forming condition is changed in accordance with the deviation determined by said first determining step and the discrimination reference determined by said second determining step, and a changing step of changing the image forming condition based on the discrimination result of said discrimination step and said deviation.

19. A method for forming an image, comprising:

a detecting step of detecting amount of toner attachment of a pattern formed on an image bearing member;

a calculating step of calculating a deviation corresponding to a reference value in accordance with the detected amount;

an image condition setting step of setting an image condition to change the image forming condition based on the calculated deviation when the calculated deviation is over a discrimination reference range;

a first determining step of determining the reference value to be used for calculating the deviation;

a second determining step of determining the discrimination reference range to be used for discriminating whether or not the image forming condition is changed;

a third determining step of determining a content of data converting means for correcting an original image and a gradation characteristic of a formed image under an image forming condition after said second determining step is ended; and an image forming step of forming an image corresponding to a converted original image in accordance with content of data converting means determined by said third determining step under the image forming condition set by said image condition setting step by use of the reference value and discrimination reference range determined by said first and second determining steps.

* * * * *